US011986076B2

(12) United States Patent
Dogagis et al.

(10) Patent No.: US 11,986,076 B2
(45) Date of Patent: May 21, 2024

(54) COMBINATION BAG, MAT, AND FLOTATION DEVICE

(71) Applicant: Aqua Hammock Bag, LLC, Fort Lauderdale, FL (US)

(72) Inventors: Geronimos Alex Dogagis, Fort Lauderdale, FL (US); Antonio Borges DeCastro, Fort Lauderdale, FL (US)

( * ) Notice: Subject to any disclaimer, the term of this patent is extended or adjusted under 35 U.S.C. 154(b) by 0 days.

(21) Appl. No.: 18/112,361

(22) Filed: Feb. 21, 2023

(65) Prior Publication Data

US 2023/0189952 A1 Jun. 22, 2023

Related U.S. Application Data

(63) Continuation-in-part of application No. 18/074,311, filed on Dec. 2, 2022, now abandoned.
(Continued)

(51) Int. Cl.
*A45C 9/00* (2006.01)
*A47G 9/06* (2006.01)
*B63B 34/52* (2020.01)

(52) U.S. Cl.
CPC ..... *A45C 9/00* (2013.01); *A47G 9/062* (2013.01); *B63B 34/52* (2020.02)

(58) Field of Classification Search
CPC .. A45C 9/00; A45C 15/00; A45C 3/10; A47C 15/006; A47G 9/062; B63B 34/50;
(Continued)

(56) References Cited

U.S. PATENT DOCUMENTS 2,819,776 A 1/1958 Balsam
3,041,638 A 7/1962 Lo Vico
(Continued)

FOREIGN PATENT DOCUMENTS

BR MU8702305 U2 6/2009
CA 2196341 7/1998
(Continued)

OTHER PUBLICATIONS

CH 261315 A Translation, Leo Kernberg, May 1949 (Year: 1949).*
(Continued)

*Primary Examiner* — Peter N Helvey
*Assistant Examiner* — Matthew T Theis
(74) *Attorney, Agent, or Firm* — Derek Fahey; The Plus IP Firm, PLLC

(57) ABSTRACT

Disclosed is a system for a combination bag, mat, and flotation device. The system includes an elongated mat having an external surface, internal surface, a mat section first side and second side, and a mat section first side and second side. A pair of flotation devices are attached to the mat section first side and second side. Each flotation device has an internal air compartment, inflation nozzle, and attachment element, and when inflated, allow the mat to be used as a flotation device. A first fastener being in attachment proximate to the mat section first side and a second fastener being in attachment proximate to the mat section second side. The first fastener and second fastener are configured to removably mate with each other. When the mat is folded so that the first fastener and second fastener are mated and the zipper is sealed, the mat forms a bag configuration.

18 Claims, 34 Drawing Sheets

Related U.S. Application Data

(60) Provisional application No. 63/285,838, filed on Dec. 3, 2021.

(58) Field of Classification Search
CPC .... B63B 34/52; A45F 4/00; A45F 4/02; A45F 4/06; A45F 3/04
USPC ..... 224/577
See application file for complete search history.

(56) References Cited

U.S. PATENT DOCUMENTS

| | | | | | |
|---|---|---|---|---|---|
| 3,818,962 | A * | 6/1974 | Muller-Scherak | A45C 9/00 | 383/3 |
| 4,375,111 | A | 3/1983 | Hall | | |
| 4,459,714 | A * | 7/1984 | Lin | A47C 27/085 | 24/DIG. 42 |
| 4,468,810 | A | 8/1984 | Longo | | |
| 4,546,507 | A * | 10/1985 | Weinstein | A45C 3/10 | 5/419 |
| 4,822,309 | A * | 4/1989 | Vandenberg | A45C 9/00 | 441/35 |
| 4,863,003 | A | 9/1989 | Carter | | |
| 5,110,219 | A | 5/1992 | Lopes | | |
| 5,437,569 | A | 8/1995 | Ming | | |
| 5,439,405 | A * | 8/1995 | Storey | B63B 34/50 | 441/127 |
| 5,535,461 | A | 7/1996 | Schwender | | |
| 7,225,483 | B1 | 6/2007 | Remblad | | |

FOREIGN PATENT DOCUMENTS

| | | | | |
|---|---|---|---|---|
| CH | 261315 | A * | 5/1949 | |
| DE | 202013105763 | U1 * | 4/2014 | A45C 11/20 |
| EP | 649613 | A1 * | 4/1995 | A45C 3/004 |
| FR | 2568756 | A1 * | 2/1986 | |
| GB | 2263232 | A | 7/1993 | |
| JP | 0570325 | A | 9/1993 | |
| JP | 2017042527 | A | 3/2017 | |
| WO | 02/082941 | A1 | 10/2002 | |

OTHER PUBLICATIONS

DE-202013105763-U1 Translation, Laun A, Apr. 2014 (Year: 2014).*
FR 2568756 A1 Translation, Feb. 1986 (Year: 1986).*
Executive Advertising, Pinterest, Beach Buddy Mat Tote Bag with Pillow, available at: https://www.pinterest.com/pin/beach-buddy-mat-tote-bag-with-pillow-65161525830756396/ (date accessed: Oct. 15, 2021).

* cited by examiner 290
220
215

210b
200

225
210a
100

130
125
305
D1
300
D2
C
110
B
105a

132a

COMBINATION BAG, MAT, AND FLOTATION DEVICE

CROSS-REFERENCE TO RELATED APPLICATIONS

This application is a continuation-in-part of U.S. Non-Provisional patent application Ser. No. 18/074,311, titled "A COMBINATION BAG, MAT, AND FLOTATION DEVICE", and filed Dec. 2, 2022, which claims the benefit of the filing date of U.S. Provisional Application Ser. No. 63/285,838 titled "A COMBINATION BAG, MAT, AND FLOTATION DEVICE" and filed Dec. 3, 2021, and each of which the subject matter of which is incorporated herein by reference.

STATEMENT REGARDING FEDERALLY SPONSORED RESEARCH OR DEVELOPMENT

Not applicable.

INCORPORATION BY REFERENCE OF MATERIAL SUBMITTED ON A COMPACT DISC

Not applicable.

TECHNICAL FIELD

The present invention relates to the field of travel accessories, and more specifically to the field of combination bag, mat, and flotation devices.

BACKGROUND

While engaging in outdoor activities such as swimming, camping, hiking, picnicking, beach going, sunbathing, or other outdoor activities, people tend to bring numerous accessories and equipment to be able to enjoy themselves. These accessories may include backpacks, travel, bags, tote bags, mats, towels, lounge chairs, beach chairs, floating chairs, flotation devices, sunshades, camping gear and tools, pool toys, clothing, sunscreen, etc. For example, when going to the beach, a general beachgoer could bring a backpack or beach bag, a towel or mat, an umbrella, and possibly a flotation device or toys. The problem, however, is that each of these items are burdensome to bring to the beach and one may be forgotten on any given day, thus decreasing the beachgoer's enjoyment of the experience.

Transporting all of these accessories for the purpose of enhancing a person's activity of choice can be difficult and cumbersome. This is especially true for those traveling in groups such as families with small children, since smaller children are unable to carry many of the items listed above. This creates a challenge for parents who wish to take their children to public pools or the beach. Traveling to such places can be a strenuous task due to the number of accessories one has to bring to enjoy such activities.

Small children cannot be left alone and sometimes need to be carried by the parent, so several trips to and from the car may be necessary to transfer all of the required accessories. This task can be further exacerbated by the likelihood of the parking lot and beach area being separated by hundreds of feet. These additional trips can make an already stressful task all the more tiring, this is especially true in the summer months where the warmer weather can also have an impact.

Even if a person wanted to limit the number of accessories they are transporting, they likely would be unable to do so since most of the accessories are necessary for enjoying the outdoor experiences. Minimizing the number of accessories is likely to severely harm the person's ability to enjoy the activity. Therefore, it would be desirable to have a system for carrying these accessories in a convenient and efficient manner that decreases the number of trips required for transporting these items. Additionally, it is desirable to reduce the total number of accessories needed without losing the enhancements these accessories provide to the enjoyment of the desired activity.

The prior art includes items like large travel bags with numerous compartments, beach accessories with wheels attached for easy transport, and versatile attaching components such as spring snap hooks, carabiner clips, bungee cord, rope, etc. all used to keep beach accessories together during the transport of the accessories from a vehicle to a beach. The problem with this prior art is that the number of steps taken increases by using the above-mentioned art. For example, large travel bags with compartments will require the beachgoer to divide up all of their accessories and sort them into compartments. Additionally, any floaties or toys will likely still need to be carried separately.

Beach accessories having wheels attached create more of a hassle for beachgoers by having to forcefully pull or push said accessory through the sand or soil covering the ground. This can create quite a hurdle when battling rough and bumpy terrain leading to stress and ultimately less enjoyment out of the day. Lastly, attachments such as carabiner clips do not solve the problem of transporting numerous beach accessories stress free. By clipping multiple accessories together, in hopes of lessening the number of trips taken, the user generally finds themselves battling the different items swinging around uncontrollably as they attempt to march forward towards the destination. This prior art ends up making the beachgoer's day more of a struggle than anticipated leaving the enjoyment of the day delayed.

As a result, there exists a need for improvements over the prior art and more particularly for a combination bag, mat, and flotation device for the purpose of enhancing the outdoor activity experience.

SUMMARY

A system for a combination bag, mat, and flotation device is disclosed. This Summary is provided to introduce a selection of disclosed concepts in a simplified form that are further described below in the Detailed Description including the drawings provided. This Summary is not intended to identify key features or essential features of the claimed subject matter. Nor is this Summary intended to be used to limit the claimed subject matter's scope.

In one embodiment, a combination bag, mat, and flotation device is disclosed. The system includes a rectangular elongated mat having an external surface, internal surface, a mat section first side and second side, and a mat section first side and second side. A pair of flotation devices are attached to the mat section first side and second side. Each flotation device has an internal air compartment, inflation nozzle, and attachment element, and when inflated, allow the mat to be used as a flotation device. A zipper is disposed on the perimeter of the mat. A first fastener in attachment proximate to the mat section first side and a second fastener in attachment proximate to the mat section second side. The first fastener and second fastener are configured to removably mate with each other. When the first fastener and second fastener are mated, the mat forms a bag configuration.

Additional aspects of the disclosed embodiment will be set forth in part in the description which follows, and in part will be obvious from the description, or may be learned by practice of the disclosed embodiments. The aspects of the disclosed embodiments will be realized and attained by means of the elements and combinations particularly pointed out in the appended claims. It is to be understood that both the foregoing general description and the following detailed description are exemplary and explanatory only and are not restrictive of the disclosed embodiments, as claimed.

BRIEF DESCRIPTION OF THE DRAWINGS

The accompanying drawings, which are incorporated in and constitute part of this specification, illustrate embodiments of the invention and together with the description, serve to explain the principles of the disclosed embodiments. The embodiments illustrated herein are presently preferred, it being understood, however, that the invention is not limited to the precise arrangements and instrumentalities shown, wherein.

DETAILED DESCRIPTION

Figure 1B:
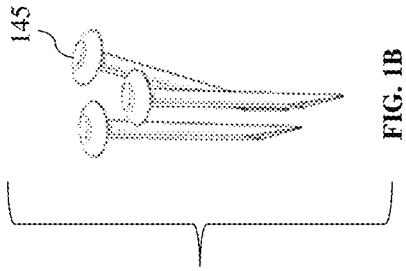
FIG. 1B is an illustration of stakes used for the device in the mat configuration, according to an example embodiment.

The following detailed description refers to the accompanying drawings. Whenever possible, the same reference numbers are used in the drawings and the following description to refer to the same or similar elements. While disclosed embodiments may be described, modifications, adaptations, and other implementations are possible. For example, substitutions, additions, or modifications may be made to the elements illustrated in the drawings, and the methods described herein may be modified by substituting, reordering, or adding additional stages or components to the disclosed methods and devices. Accordingly, the following detailed description does not limit the disclosed embodiments. Instead, the proper scope of the disclosed embodiments is defined by the appended claims.

The disclosed embodiments improve upon the problems with the prior art by providing a system for combining a bag, mat, and flotation device for the purpose of enhancing a user's experience with outdoor activities. The system defines a combination bag, mat, and flotation device that optimizes the outdoor activity experience by reducing the number of accessories one needs to individually bring for such activities. The system improves upon the prior art by providing a bag that, at any time, can be converted into either a mat, for laying on, or a flotation device. The system may further include a plurality of attachable accessories which enhance the functionality of the system. In the bag configuration, the system can be used to carry the plurality of attachable accessories as well as various personal items. The system improves over the prior art by providing a multifunctional system that enhances the outdoor activity experience by reducing the number of items one needs to travel with and providing an efficient method for transporting such items. The system further improves upon the prior art by allowing the user to adapt the system to ever changing factors such as weather conditions or participating in different activities.

Figure 1A:
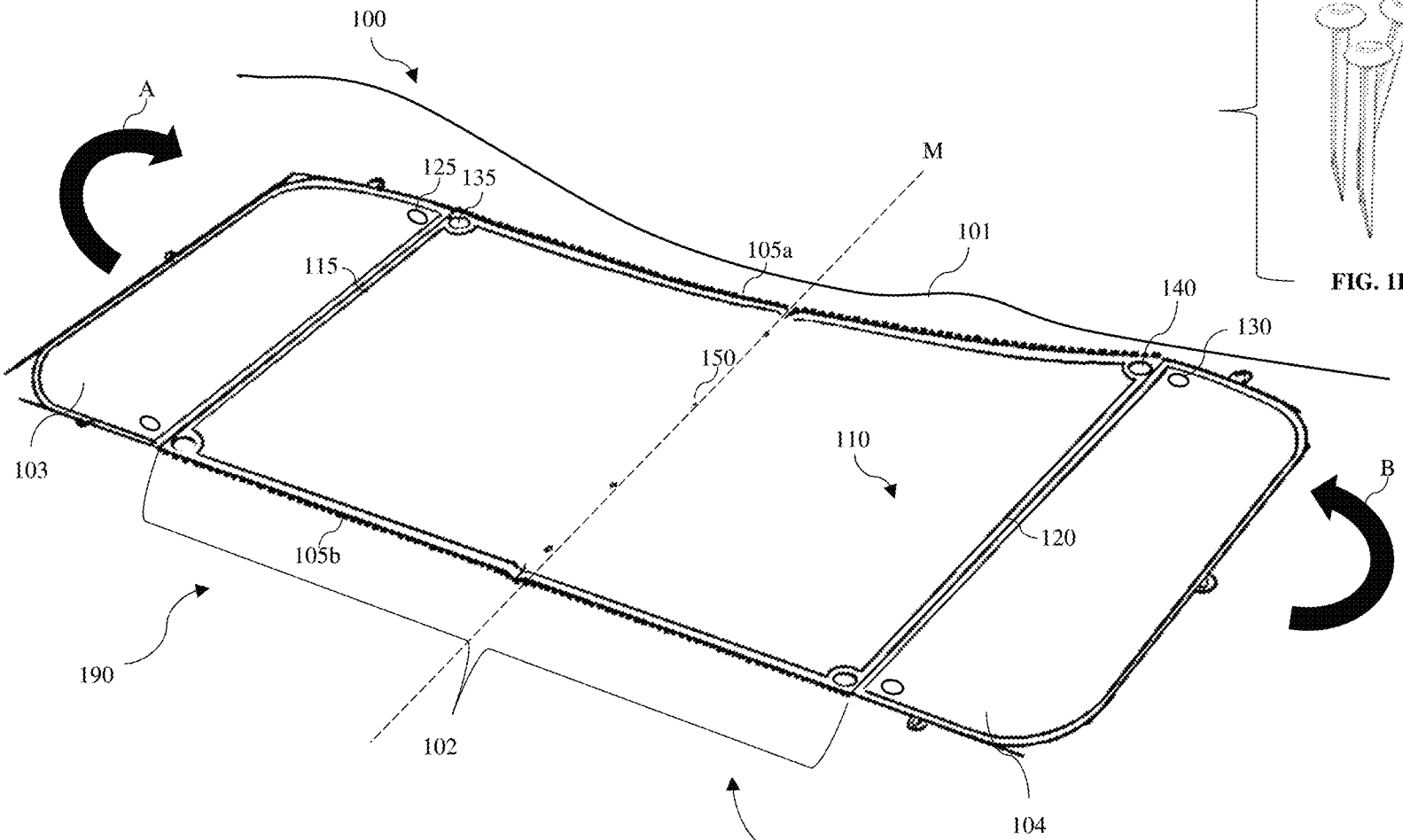
FIG. 1A is a perspective view of a combination bag, mat, and flotation device in a mat configuration, according to an example embodiment.

Referring now to FIGS. 1A and 1B, a perspective view of a combination bag, mat, and flotation device 100 in a mat configuration 190 is shown, according to an example embodiment. FIG. 1B illustrates example attachment elements, such as stakes, used to secure the device, in the mat configuration, to a ground, such as sand or soil. As illustrated, the combination bag, mat, and flotation device is shown in a mat configuration. The combination bag, mat, and flotation device 100 includes a mat 102. The mat includes an internal surface 110 and an external surface 111, a mat section first side 115, and a mat section second side 120. As shown, the internal surface of the mat is upward facing, and the external surface of the mat is oriented downwards proximate to a ground surface 101. The ground surface may be any surface of which people lay a mat down, including but not limited to, sand, snow, grass, asphalt, and/or any objects wherein a person may sit or lay down on. The mat is substantially rectangular and elongated such that the mat may be configured to be the length of a person for example.

The mat may be defined by a middle section of the device such that the mat includes a flotation device 103, 104 in attachment with the mat on either end of the mat. Flotation device 103 is in attachment with the mat section first side 115 and flotation device 104 is in attachment with the mat section second side 120. Each of the pair of flotation devices 103, 104 has an internal air compartment and an inflation nozzle. The user can user the inflation nozzle to insert air into the flotation device. The flotation device will inflate with air and expand. As a result, the air within the internal air compartment of each of the flotation devices allows the device to float when within water. However, while in operation in the mat configuration each of the flotation devices may act as a pillow to support the users head and/or legs while resting on the mat. Otherwise, in the mat configuration, the user may have each of the flotation devices deflated.

The substantially rectangular elongated mat includes a zipper 105*b* disposed on a mat perimeter. The zipper may be disposed on a portion of the perimeter of the mat, such as the perimeter of the map that is not in attachment with a flotation device. The zippers are disposed on the perimeter of the mat to allow the user to quickly fold the mat in half and zip each of the zipper 105*b* closed to transform the device from the mat configuration into the bag configuration. The user folds the mat by moving the mat section first side proximate to the mat section second side or by folding the mat in half across midline M.

The mat may be constructed from one or more types of fabrics or materials such as polyester, fleece, nylon, microfiber, plastic, etc. In one embodiment the fabric is a material that is water, chemical, and sun resistant. The design of the material may be a solid color, multiple colors, or other patterns such as stripes, plaid, floral, camouflage, etc. In certain embodiments the internal surface of the mat may be comprised of different materials than the external surface of the mat. For example, because the internal surface is configured to contact user such that it is configured to be sat or laid upon, then the internal surface may include cotton and/or other soft materials. Comparingly, because the external surface is configured to contact the ground surface, the external surface may include more durable materials suitable to withstand the natural elements, such as nylons, and polyesters. In other embodiments, to reduce the weight of the device and to allow sand and water to easily permeate the mat, the mat may be defined by a mesh pattern or mesh-like material.

The mat further comprises a first fastener 125, or side fastener, in attachment proximate to the mat section first side, a second fastener 130, or the adjacent side fastener, in attachment proximate to the mat section second side, a first pair of holes 135 proximate to the mat section first side, and a second pair of holes 140 proximate to the mat section second side. The first fastener and second fastener are configured to removably mate with each other. In one embodiment the first fastener and second faster may be plastic grommets configured to snap fit when they are pressed against each other when a force is applied. In other embodiments, the first fastener and second fastener may be magnets of opposite poles so that the first fastener and the second fastener can removably mate with each other. Furthermore, the first fastener and second fastener may include hook and loop elements, or Velcro®, so that the mat section first side can removably mate with the mat section second side. Ideally, each of the first fasteners and the second fasteners are at least disposed on the mat proximate to a corner of the mat. Being disposed on the corner of the mat allows the mat to hold together to retain the bag configuration. In other embodiments, the first fastener and the second fastener may extend the length of each of the mat section first side and second side to allow the device to open and close in the bag configuration. In the bag configuration, when the zippers 105*b* are closed, the zippers will define the sides of the bag and the mat section first and second side will define the tip of the bag.

The pair of first holes and pair of second holes be configured to each receive a stake in the mat configuration. A stake may be ideal to secure the mat to the ground surface. For example, on a windy day, the user may want to prevent the device from blowing away, so the user may insert stages into each of the first holes and the second holes and into the ground surface. The system may include at least four stakes 145, each configured to secure the substantially rectangular elongated mat to a ground surface. In other embodiments, depending on the size and length of the elongated mat, the mat may include fewer or more first and second holes. Correspondingly, the system may include as many stakes as are holes in the mat to adequately secure the mat to the ground surface. In the mat configuration, the stakes may be inserted through the pairs of first holes and second holes and into the ground to keep the mat secured in place. In this configuration the mat can be used for various leisure activities. In one embodiment, the mat may be placed over the sand area of a beach and laid on so that the user may sunbathe comfortably. To insert, the user could align a stake vertically, through the center of a hole and press with a downward force using either their hand, foot, or a tool such as a hammer, until a majority of the length of the stake has passed through the hole and into the ground. Additionally, to cover a larger portion of the ground surface with the device, the user may overlay a second device and line up the holes of the second device with the holes of the first device. Then the user may insert the stakes into the holes to secure the second device to the first device. By connecting two mats together the user can cover a larger surface area to enjoy its leisure activities. In other embodiments, the user may connect the second device to the first device using the first and second fasteners, or by using a clasp, such as a zip tie, twine, or carabiner clip for example, to secure both devices together, In other embodiments, the system may further comprise an at least one drain hole 150. In an example embodiment, the at least one drain holes are located at the center of the mat and are arranged in a straight line parallel to the mat section first side and mat section second side. The function of the drain holes is to remove excess water, sand, and/or dirt that may compile on the mat when a user lays on it after being in a pool, ocean, or any other body of water.

Figures 2A, 2B, 2C:
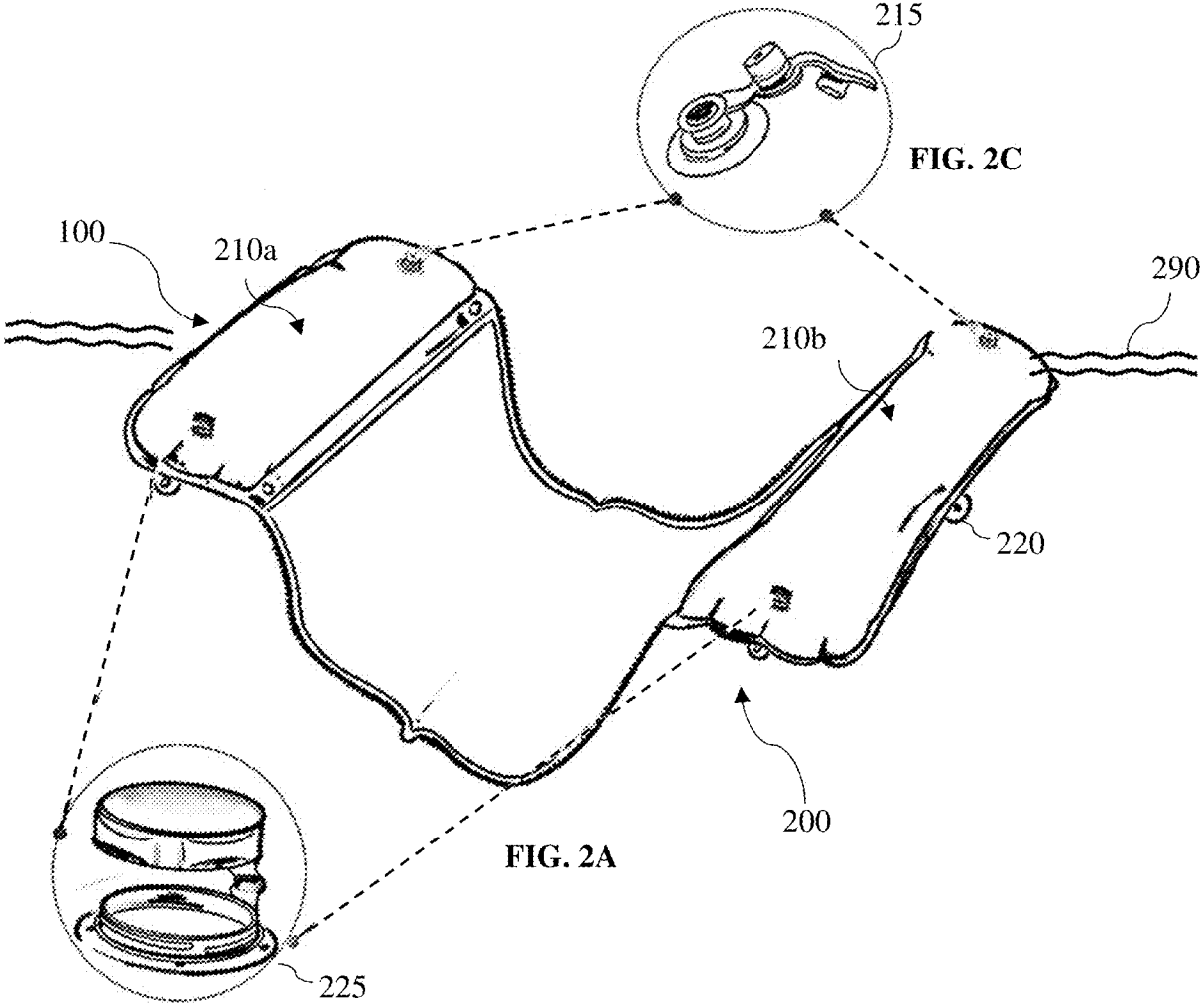
FIG. 2A is a perspective view of the combination bag, mat, and flotation device in the flotation device configuration, according to an example embodiment.
FIG. 2B is a detailed view of a quick-release air valve shown in FIG. 2A, according to an example embodiment.
FIG. 2C is a detailed view of the air intake valve shown in FIG. 2A, according to an example embodiment.

Referring now to FIGS. 2A through 2C, a perspective view of the combination bag, mat, and flotation device 100 in the flotation device configuration 200 is shown, according to an example embodiment. The flotation device configuration is when each of the flotation devices is inflated such that air is within the internal air compartment and the device is in a body of water 290, such as an ocean, pool, lake, river, etc. Because air is in each of the flotation devices, the device will float. In the flotation device configuration 200 the mat is in attachment with a pair of flotation devices, wherein one of the flotation devices is in attachment with a mat section first side and another with a mat section second side. Each flotation device comprises an internal air compartment 210*a*, 210*b*, inflation nozzle 215, attachment element 220, and an air nozzle exhaust valve 225. The inflation nozzle and the air nozzle exhaust valve may be one-way nozzles allowing air to pass through. The inflation nozzle only allows air to enter the internal air compartment such that the internal air compartment may inflate without letting any air escape. The air nozzle exhaust valve may be opened to easily release air from within the internal air compartment to outside of the internal air compartment.

The flotation devices may be inflated by inserting a manual or electric air pump into the inflation nozzle and forcing air into the internal air compartment. Once inflated, the user may lay on the mat, using the mat section first side flotation device as a pillow or headrest and the mat section second side flotation device as a footrest. The mat may also be taken into a body of water such as a pool and used as a flotation device for sitting or lying on. The air nozzle exhaust valve, when opened, can be used to quickly deflate a flotation device.

In the flotation device configuration, the combination bag, mat, and flotation device can serve several uses. It can be rested on and used as a means of relaxation or sunbathing for users who wish to relax in the pool or other bodies of water. A parent of a small child or child who cannot swim can place their child on the flotation device so that they can be brought into the pool area without having to be held onto.

Figures 3A, 3B, 3C:
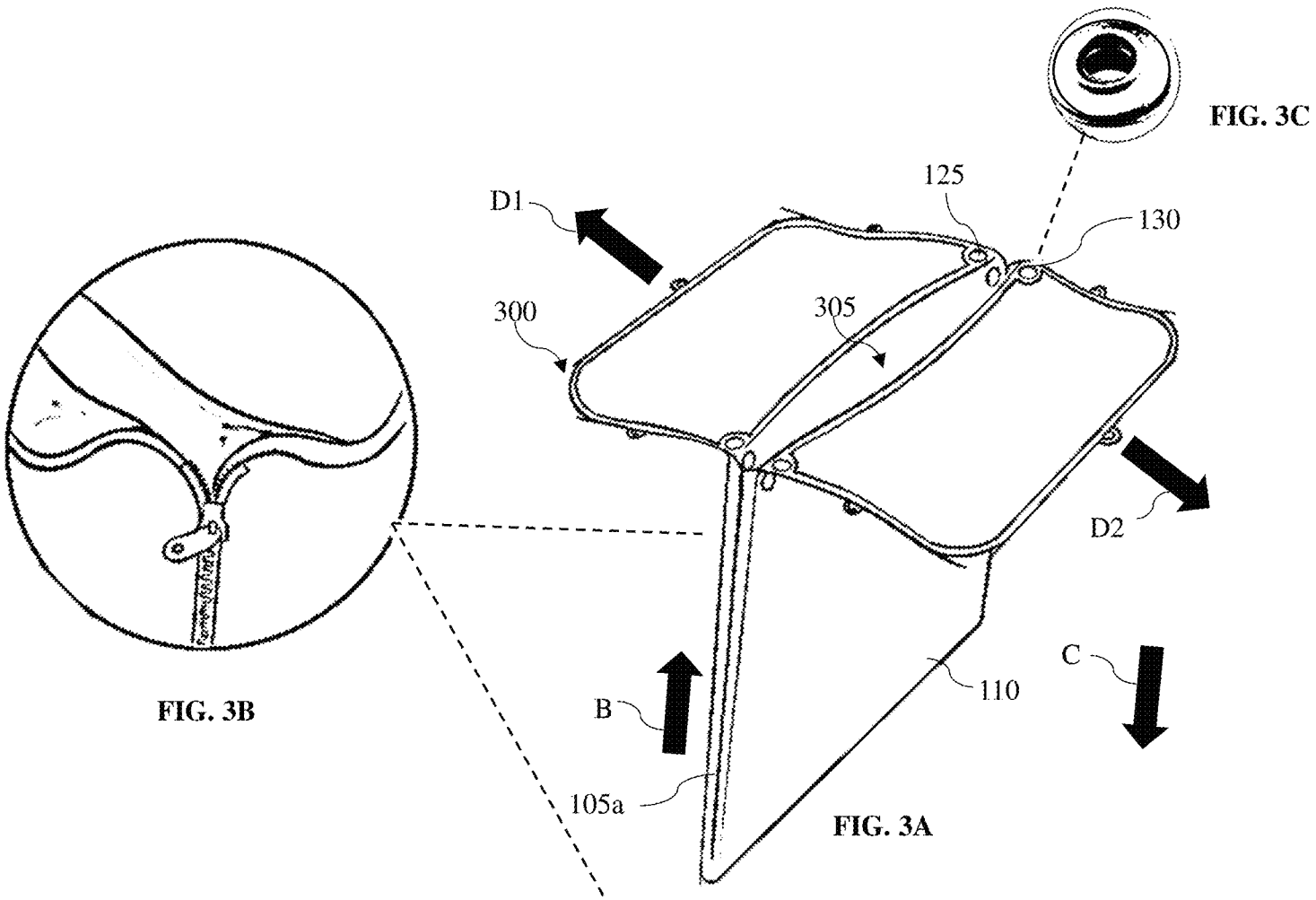
FIG. 3A is a perspective view of the combination bag, mat, and flotation device in the bag configuration, according to an example embodiment.
FIG. 3B is a detailed side view of zipper shown in FIG. 3A that is used to convert the device from the mat configuration to the bag configuration and visa-vera, according to an example embodiment.
FIG. 3C is a detailed side view of snap rivet shown in FIG. 3A that is used to convert the device from the mat configuration to the bag configuration and visa-vera, according to an example embodiment.
Figures 4A, 4B, 4C:
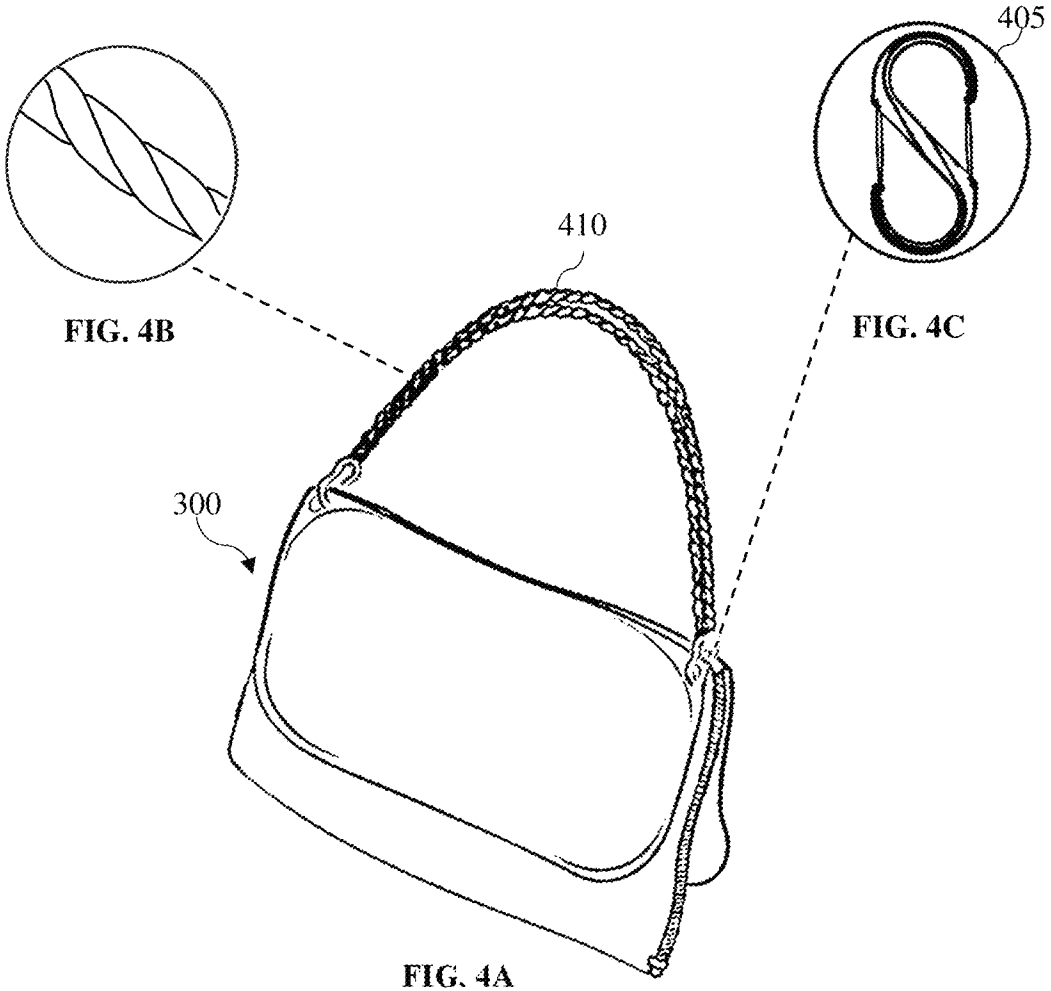
FIG. 4A is a perspective view of the combination bag, mat, and flotation device in the bag configuration having an attached handle, according to an example embodiment.
FIG. 4B is a detailed view of a handle of the device in the bag configuration as shown in FIG. 4A, according to an example embodiment.
FIG. 4C is a detailed view of a carabiner clip used to connect the handle to the device in the bag configuration, as shown in FIG. 4A, according to an example embodiment.

Referring now to FIGS. 3A through 4C, the device is shown in the bag configuration. FIG. 3A and FIG. 4A illustrate a perspective view of the combination bag, mat, and flotation device in the bag configuration, according to an example embodiment. The embodiment of FIG. 4A includes a handle in attachment, shown in FIG. 4B, with the device in the bag configuration. The embodiment of FIGS. 3A and 4A is achieved by folding the device 100 of FIG. 1A over the midline M. The user will grab the flotation device 103 and move it in direction A towards the midline M and also grab flotation device 104 and move it in direction B towards the midline. As a result, the mat section first side and mat section second side will be proximate to each other. The user can then, in no specific order, either close the zippers 105*b* forming the sides of the bag and secure the first fasteners 125 to the second fasteners 130. The resulting configuration of the device is the bag configuration. The mat may be converted to a bag configuration 300 by folding the mat so that a first portion of the internal surface 110 faces a second portion of the internal surface, the first fastener 125 is removably attached to the second fastener 130, and the zipper is fastened. The internal surface will define the internal compartment storage 305 when the zippers are closed. The external surface 111 forms the outer area of the bag.

In certain embodiments, the mat may have pockets on the internal surface such that when the device is in the bag configuration, the internal storage compartment also has said pockets. The internal storage compartment may hold and/or store various items such as additional mat accessories or personal items such as sunglasses, mobile devices, water bottles, keys, wallets, towels, beach toys, camping accessories, food, etc. In embodiments where the mat is mesh or a mesh-like material, the internal storage compartment may be configured to receive a liner, which is further detailed in FIGS. 5A through 6. The liner may be a watertight compartment configured to protect various personal items and electronic devices from elements such as sand and water. In other embodiments, the line may be insulated such that the device in the bag configuration will define a cooler. The insulated line may hold ice, water to keep any beverages or food items stored within the internal storage compartment cold.

The mat further comprises an at least one securing element 405 and a handle 410. The securing element is configured to removably attach to at least one of the attachment element, the first pair of holes, the second pair of holes, the accessory, and a second combination bag, mat, and flotation device. In an example embodiment, the securing element may be a carabiner. The handle is configured to attach to the pair of first holes 135 and to the pair of second holes 140 when the pair of first holes are proximate to the pair of second holes. The handle may be a strap configured to attach to the securing elements such that the user may carry the mat in the form of a bag. The strap may be attached to an at least one securing element in attachment with the pair of first holes and pair of second holes. The strap can be made from one or more materials such as cotton, nylon, polyester, leather, metal, etc. Other materials may be used and are within the spirit and scope of the present invention. When the strap is in attachment with the mat in the bag configuration, the user may carry the bag by holding the strap in her hand or resting the strap on her shoulder.

In an example embodiment, the combination bag, mat, and flotation device can be converted from a mat configuration to a bag configuration by folding the ends of the mat in the A1 and A2 direction (as shown in FIG. 1A), attaching the first fastener to the second fastener, sealing the zipper by fastening the zipper handle and sliding it in the B direction, and attaching the handle. The attached, deflated flotation devices will act as flaps which hang to the sides of the bag. The handle can be attached by connecting a device such as a carabiner to each end of the handle and/or to the pair of first holes and to the pair of second holes when the pair of first holes are proximate to the pair of second holes.

When the combination bag, mat, and flotation device is in this bag configuration it can be used to optimize travel and transportation of items to and from the destination of the desired outdoor activity. In an example embodiment, it can be used to carry items to the beach such as a cell phone, keys, wallet, water bottle, food, sunglasses, sunscreen, etc. Additionally, the drain holes, located at the bottom of the bag in this configuration, can be used to remove any water, sand, or other foreign particles that may be brought into the bag unintentionally. Since all of these items can be stored in the combination bag, mat, and flotation device the user does not need to bring a separate beach bag nor does she need to bring a beach blanket or flotation device. The reduction in items results in fewer trips and less strenuous trips to and from the car.

Once the user has arrived at the desired location, such as, the beach, she can convert the bag back to its mat confirmation. This is done by emptying the contents of the bag, detaching the handle, sliding the zipper handle in the C direction, and pulling the flotation device flaps in the D1 and D2 directions with sufficient force. Here, sufficient force means enough force to detach the first fastener from the second fastener. The user should then be able to lay the mat flat on the ground and if desired, can insert the stakes to keep the mat in place. When not in use, items such as the handle, carabiners, and stakes may be stored for safekeeping in the pocket liner (as described below in FIG. 5A through FIG. 6).

Figures 5A, 5B, 5C:
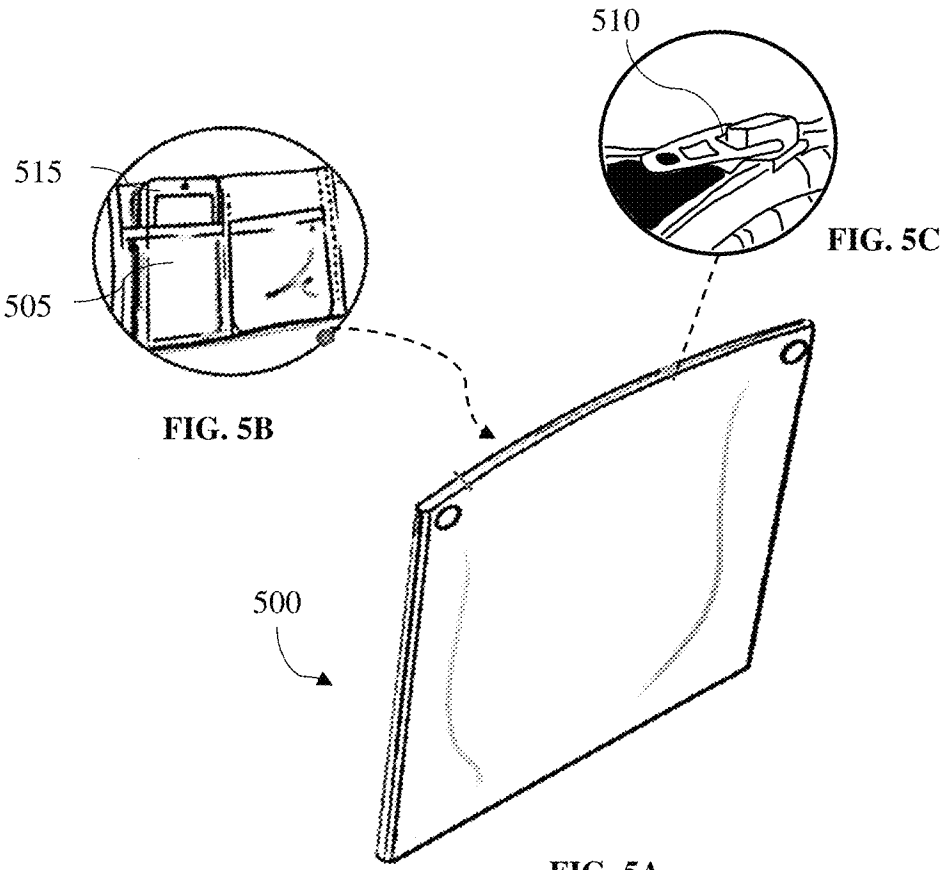
FIG. 5A is a perspective view of a pocket liner which may be inserted into the combination bag, mat, and flotation device in the bag configuration, according to an example embodiment.
FIG. 5B is a detailed side view of the pocket liner shown in FIG. 5A, according to an example embodiment.
FIG. 5C, is a detailed view of a closing mechanism that may be used to close the pocket liner of FIG. 5A, according to an example embodiment.
Figure 6:
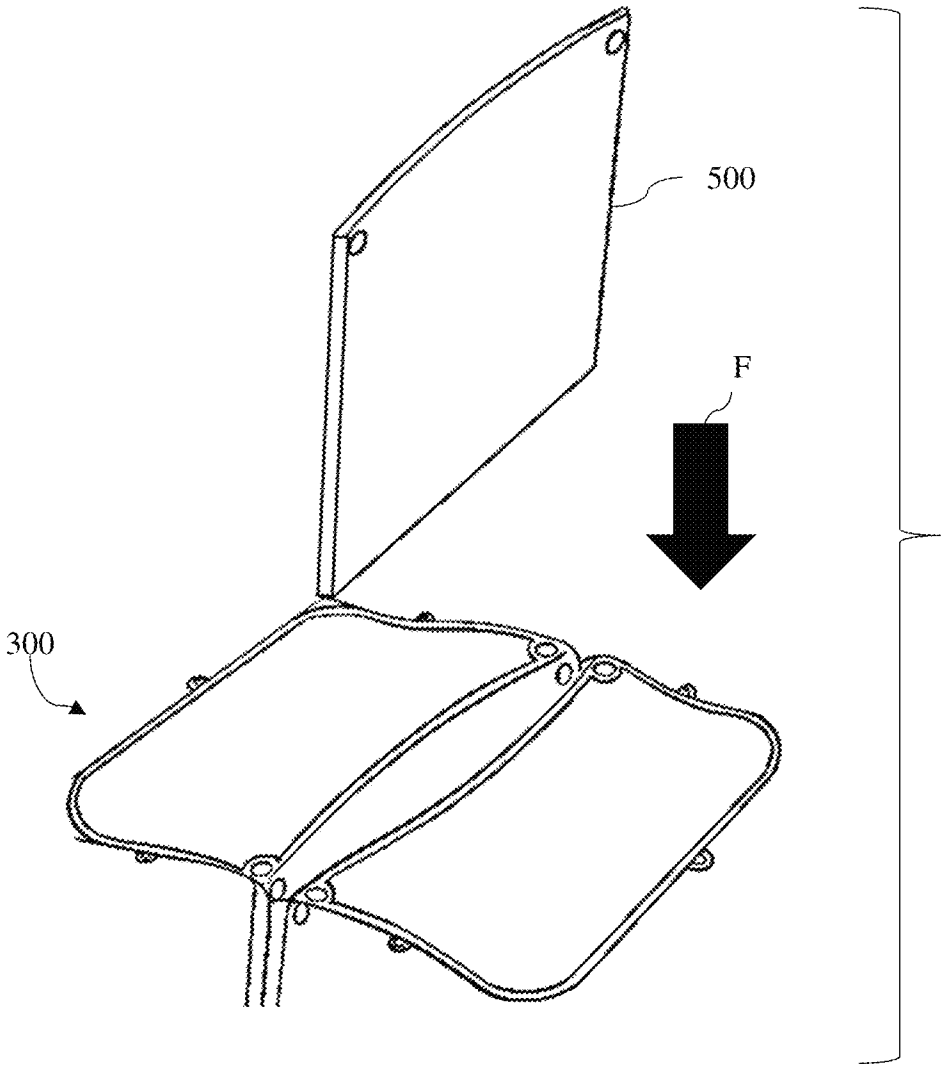
FIG. 6 is a second perspective view of the pocket liner being inserted into an internal storage compartment of the combination bag, mat, and flotation device in the bag configuration, according to an example embodiment.
Figures 7A, 7B, 7C, 7D:
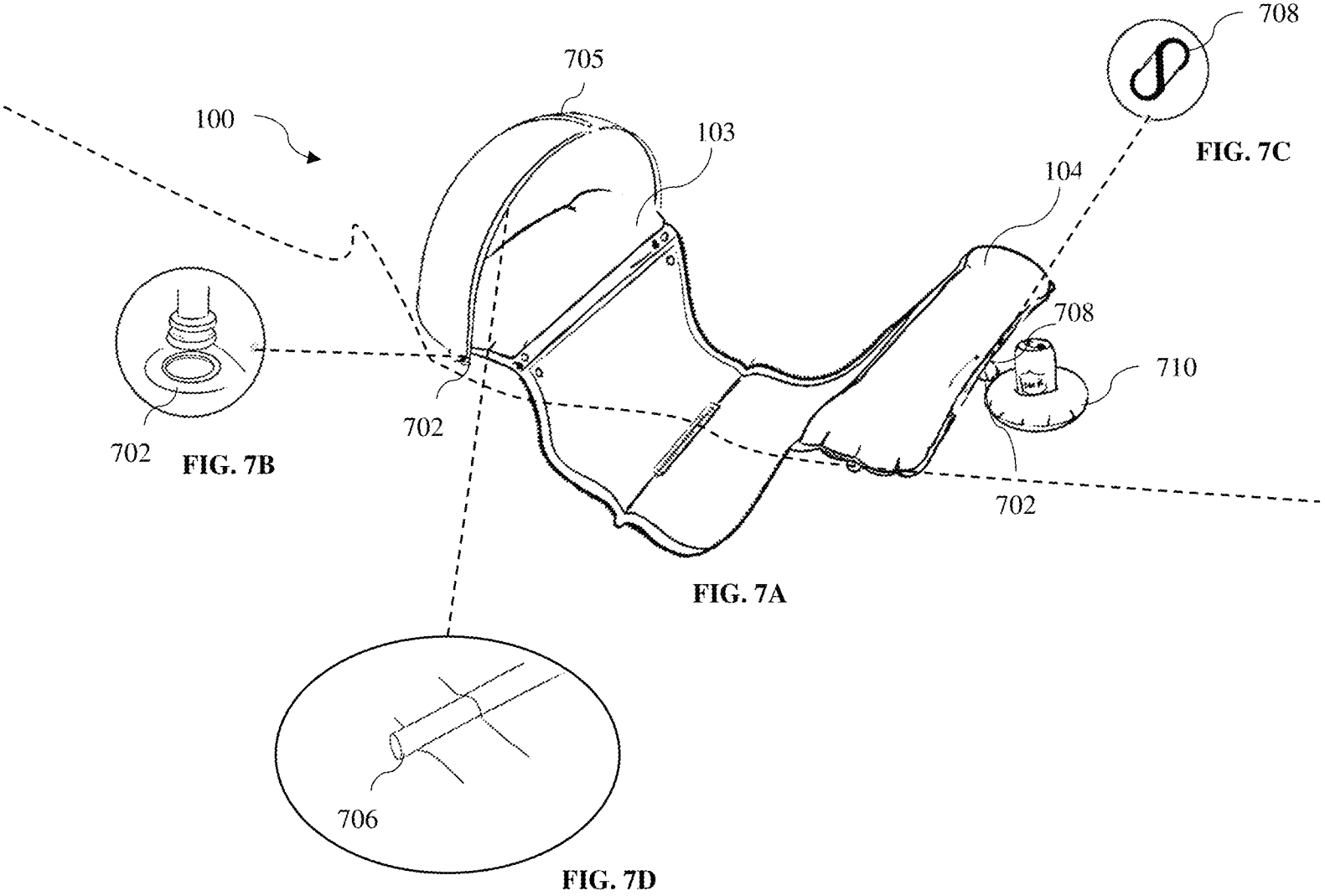
FIG. 7A is a perspective view of the combination bag, mat, and flotation device in the flotation device configuration and in attachment with various accessories, according to an example embodiment.
FIG. 7B is a detailed view of the connection point shown in FIG. 7A for connecting a sun-shade attachment to the device, according to an example embodiment.
FIG. 7C is a detailed view of a connecting element shown in FIG. 7A, such as a carabiner clip, used to connect an attachment to the device, according to an example embodiment.
FIG. 7D is a detailed view of the support frame for the sunshade attachment shown in FIG. 7A, according to an example embodiment.

Referring now to FIGS. 5A through 6, a perspective view of a pocket liner which may be inserted into the combination bag, mat, and flotation device in the bag configuration 300 is shown, according to an example embodiment. The pocket liner 500 may be used to store and organize items 515 such as mat accessories or personal items such as cell phones, keys, wallets, cameras, water bottles, food, etc. The pocket liner may be constructed from the same material as the mat or another material that is insulative, such as aluminum, so that the pocket liner may be used as a cooler. In other embodiments, the pocket liner may be constructed from other materials configured to protect the items from environmental objects, such as sand or water. In an example embodiment, the pocket liner has pockets 505 for storage, an internal compartment and zipper 510 for sealing the internal compartment and is constructed from aluminum. In other embodiments, the pocket liner might be sealed using an interlocking mechanism configured to airtightly enclose the items within the pocket liner. The interlocking mechanism may be similar to those commonly used on sandwich bags. However, other sealing tools may be used that are configured provide an airtight seal on the pocket liner. The pocket liner may be used to store drinks such as water, juice, soda, etc. or food items that need to be kept cool for the duration of time that the user is enjoying the outdoor activities. The insulated pocket liner eliminates the need to bring a device such as a cooler, therefore, further reducing the number items necessary for the outdoor activity. This is especially true for activities such as camping, picnicking, or going to the beach since a cooler would typically be desired.

In the bag configuration, the pocket liner can be inserted into the combination bag, mat, and flotation device's internal compartment storage 305. The pocket liner is configured to fit in the internal compartment storage when inserted in the F direction.

Referring now to FIGS. 7A through 9D, a perspective view of the combination bag, mat, and flotation device in the flotation device configuration and in attachment with various accessories and/or at least one second combination bag, mat, and flotation device is shown, according to an example embodiment. In the flotation device configuration, the combination bag, mat, and flotation device 100 may be in attachment with at least one of an accessory or second combination bag, mat, and flotation device 900. The accessories may include, according to an example embodiment, a sunshade 705 and a cup holder 710. The sunshade and cup holder may be in attachment with the device when the device is in the mat configuration and the bag configuration. The device may be in attachment with other accessories and such accessories are within the spirit and scope of the disclosure. Example accessories may include toys, sunglass holders, coolers, umbrellas, etc. The device may include attachment elements which may be disposed on each of the flotation devices 103, 104. The attachment element is configured to receive the accessory, such as sunshade 705 for example. The accessory may removably attach to the attachment element using a securing element, such as securing element 708 which is a carabiner, or be configured to press-fit or friction fit into the attachment element. In other embodiments, the accessory may attach to other portions of the device, such as attaching to the first holes and second holes using the securing element, and/or attaching to either the first or second fasteners. Ideally, the accessories will attach to the device at designated attachment tabs disposed on the perimeter of the device which may include the perimeter of the mat and the perimeter of each of the flotation devices.

In an example embodiment, the sunshade may be an easy snap sunshade that uses a wire 706 or other ridged material to keep the curved shape of the sunshade. The sunshade is configured to removably attach to the pair of first holes so that it may protect the headrest area of the flotation device from sun exposure. The sunshade can be used in attachment with either the combination bag, mat, and flotation device's mat configuration or flotation device configuration, depending on the user's preference. When the combination bag, mat, and flotation device is in the bag configuration, the sunshade can be stored in the internal compartment storage 305. The user may rest his or her head on the flotation device 103 which will be covered by the sunshade. In such a position, the user's legs will be positioned on top of flotation device 104 and the user's body will by contained within the internal surface. The device will keep the user afloat in the water to enjoy a leisurely drift and relaxing experience.

In the same embodiment or other embodiments, a cup holder may be configured to removably attach to the attachment element 220. The cup holder can be removably attached to the attachment element by means of a connecting device such as a carabiner. The cup holder may be configured to float and can be used while the combination bag, mat, and flotation device is in the flotation device configuration for the purpose of holding drink cups, canned drinks, or bottled drinks while in the water. When the combination bag, mat, and flotation device is in the bag configuration, the cup holder can be stored in the internal compartment storage. The cup holder may also be a tumbler or other drink container configured to attach to the device.

In the same embodiment or other embodiments, at least one of a second combination bag, mat, or flotation device may be configured to removably attach to the at least one of the attachment element, the first pair of holes, and the second pair of holes. At least one of a connecting device such as a carabiner may be used to removably attach the at least one of the attachment element, the first pair of holes, and the second pair of holes of the combination bag, mat, and flotation device to the at least one of the attachment element, the first pair of holes, and the second pair of holes of a second combination bag, mat, and flotation device. The multiple combination bag, mat, and flotation devices may be used in attachment with each other so that a single user may have more area to lay on or for multiple users to share.

Figure 8A:
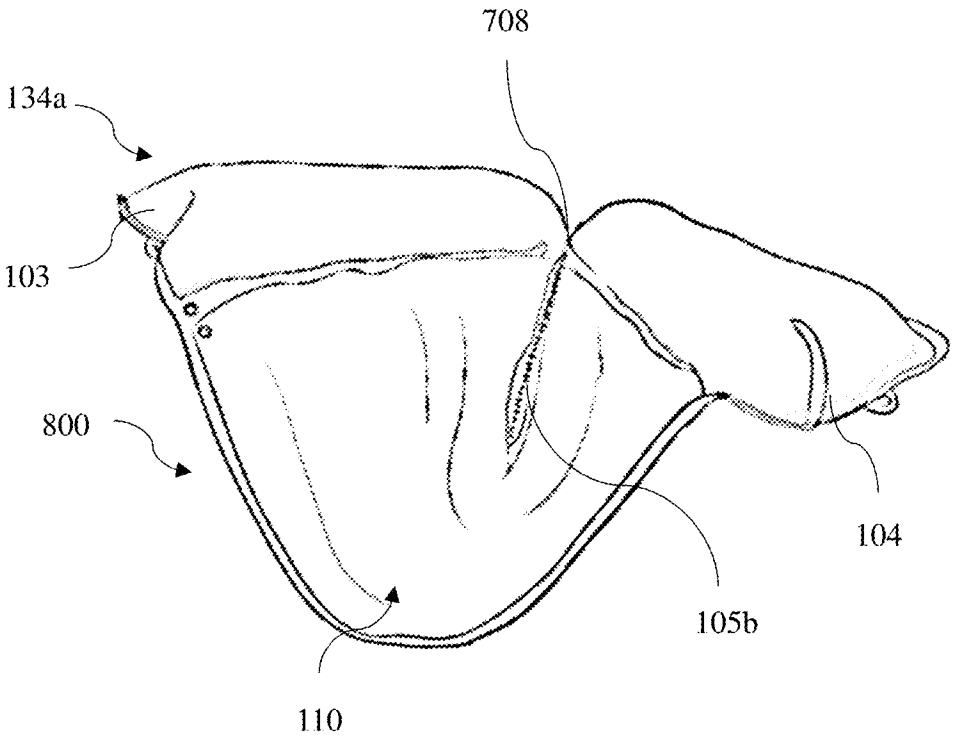
FIG. 8A is a perspective view of the combination bag, mat, and flotation device in the flotation device configuration and in attachment with at least a second the combination bag, mat, and flotation device, according to an example embodiment.
Figure 8B:
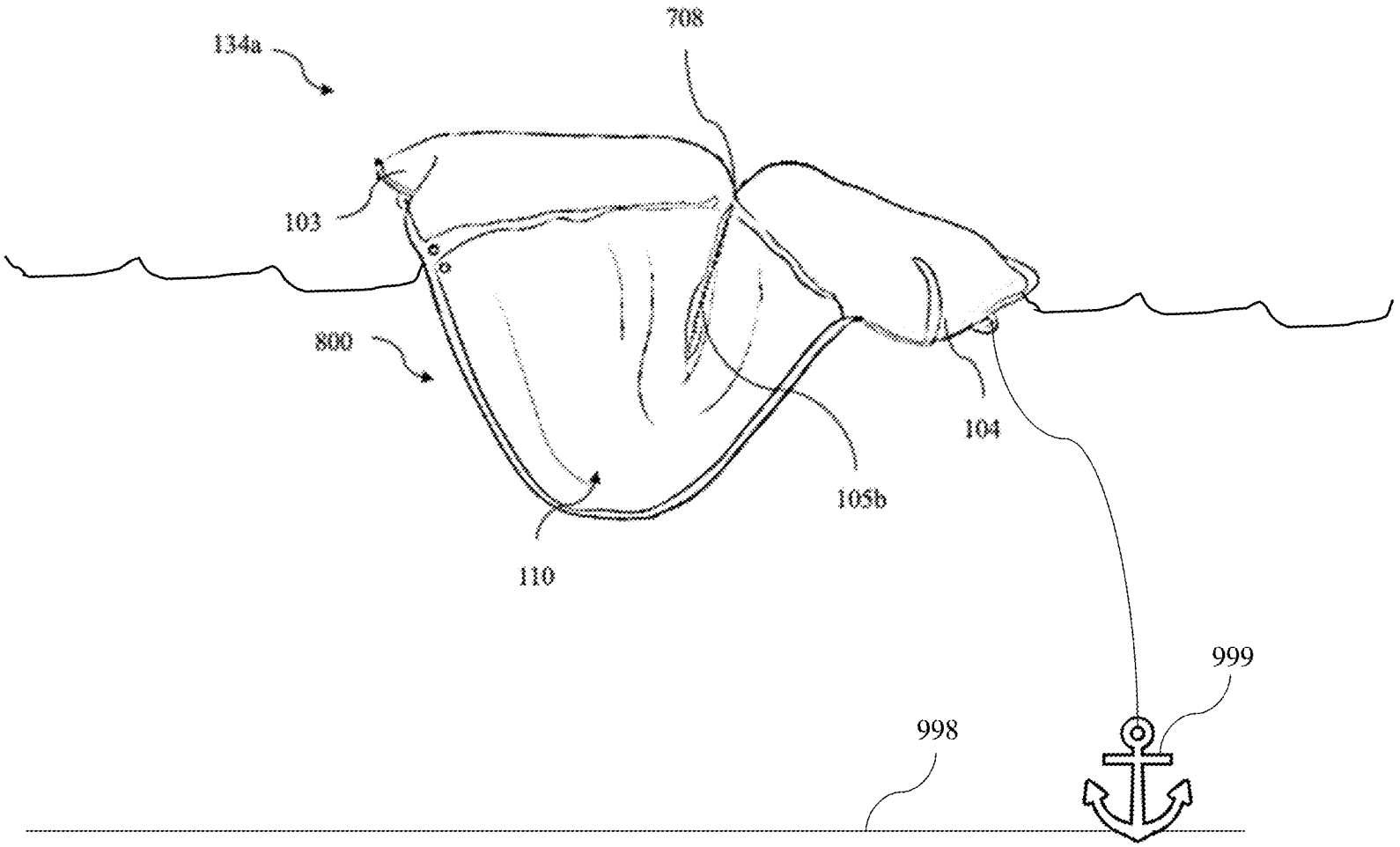
FIG. 8B is a perspective view thereof having an anchor positioned on the ground attached to a tab on the flotation device, according to an example embodiment.

Referring to FIG. 8A and FIG. 8B, a perspective view of the combination bag, mat, and flotation device in the flotation device chair configuration is shown, according to an example embodiment. In the example embodiment, the combination bag, mat, and flotation device 100 can be further configured to be in a chair configuration 800. Based on the embodiments disclosed herein, there are numerous ways to achieve the chair configuration. For example, the user may attach a securing element 708 or connecting device, such as a carabiner, on one of each of the first holes and second holes on the same side of the mat. This will only bring two of the holes proximate to each other allowing the user to sit on the internal surface in the flotation device configuration. Also, the user may attach one of the pair of first and second side fasteners together to create an embodiment of the same function. In other embodiments, the user may close one of the zippers 105*b* or connect two ends of the device via a securing element in attachment with the attachment tabs on each of the flotation devices 103 and 104. In this char configuration the user will sit on the internal surface and each of the flotation devices 103 and 104 will define arm rests for the user.

In other words, the chair configuration may be achieved by using a connecting device such as a carabiner to link the mat section first side of the flotation device to the mat section second side of the flotation device. The carabiner may be connected to an attachment element, or one of the first and second holes to create the chair configuration. When the flotation device is oriented in the chair configuration the combination bag, mat, and flotation device is in a body of water, the mat portion of the system will form a corner shaped pocket which the user can sit in and leisurely enjoy the day out on the water. As shown in FIG. 8B, some embodiments may include an anchor 999 being attached to a link that can be used for anchoring the float in the water to the floor 998 of the body of water in which the device is located. The anchor may be attached to at least one of the plurality of tabs on the device. For example, the device may have a tab on the bottom side of the device, such as the bottom panel and/or a section of the device that is under the water line in the flotation configuration. The anchor may attach to such a tab below the water line to prevent entanglement with the user, the device, and or multiple devices with the anchor. Moreover, the anchor may attach to one or more devices to anchor a group of users in a flotation configuration to a particular area. The anchor may be attached to the device(s) by means, including but not limited to, string, twine, and/or a carabine clip to fasten the anchor to at least one of the tabs on the device. The anchor may be weighted accordingly to hold the user and/or the device in place. The anchor may also be any type of anchor, such a grappling anchor and/or a mushroom anchor for example. Other anchors are within the spirit and scope of the disclosure.

As shown in FIGS. 9A through 9E, if multiple users are each using a combination bag, mat, and flotation devices in the flotation device configuration, they could connect them using one of the methods described herein so that the users do not get separated from one another while in the water. In an example embodiment, the combination bag, mat, and flotation device, while in the flotation device configuration, is in attachment with a second combination bag, mat, and flotation device 900, which is also in the flotation device configuration, in a lengthwise configuration. To achieve the lengthwise configuration, a connecting device such as a carabiner may be removably attached to an attachment element 702 of a flotation device 104 with the attachment element 702 of the flotation device 103 of the second device 900. Embodiments supporting additional devices, such as three or more, in attachment with one another in this configuration 905 are within the spirit and scope of the disclosure.

In another example embodiment the combination bag, mat, and flotation device, while in the flotation device configuration, is in attachment with a second combination bag, mat, and flotation device, which is also in the flotation device configuration, in a side-by-side configuration 910. To achieve the side-by-side configuration, the flotation device 103 of device 100 may be in attachment with the flotation device 103 of device 900 via a securing element in attachment at least one of the attachment tabs on each of the flotation devices or by connecting the first holes of device 100 to the first holes of device 900. Also, in this side-by-side configuration, the flotation device 104 of device 100 may be in attachment with the flotation device 104 of device 900 via a securing element in attachment at least one of the attachment tabs on each of the flotation devices or by connecting the second holes of device 100 to the second holes of device 900. The first flotation device 100 and second device 900 may similarly be connected in the mat configuration to create a mat covering a larger surface area of the ground surface. In this embodiment, each respective mat section first side and mat section second side align parallel with one another. In this side-by-side configuration, the attached pair of combination bag, mat, and flotation devices may be used by a single user as a larger area for laying or by multiple users for sharing a laying space. Embodiments supporting additional devices, such as three or more, in attachment with one another in this configuration 910 are within the spirit and scope of the disclosure.

In other embodiments, as depicted in embodiment 915 and 920, numerous second devices 900 may be in attachment with the device 100 in the chair configuration. Embodiments supporting additional devices, such as three or more, in attachment with one another in embodiment 915 are within the spirit and scope of the disclosure. Such an example embodiment having three or more devices in attachment with one another is shown in embodiment 920. As shown, the device 100 has a second device 900 attached to each flotation device. The user may want to connect multiple devices together to create a social group to enjoy the outdoor activities. This embodiment addresses a common issue with the prior art in that a group of people, floating down a river for example, may tie their rafts together with twine thereby creating a tangled web of rope having high tension which may be dangerous to the rafters. The web of rope may be a choking hazard or may cross over other rafts which may cause discomfort or even rope burn. This embodiment 920 address a solution to the problem creating a unitary device connecting multiple devices in an orderly manner. FIG. 9E is a detail view of the side-by-side configuration, where the flotation device may be in attachment with a second flotation device via a securing element in attachment to at least one of the attachment tabs on each of the flotation devices. In this figure, the two flotation devices are attached by an attaching element such as a carabiner.

The multiple devices may be connected in an open shape as shown in embodiment 920 or may be enclosed, such as creating a circular shape, such that flotation device 904 may be in attachment with flotation device 903 in embodiment 920. Furthermore, the device 100 may be in attachment with both an accessory and a second device. Moreover, the users may connect multiple devices where each device is in a different configuration. For example, the user may have some devices connected in the side-by-side configuration where one of the devices is also in a chair configuration 800 and the other is not. Other permutations connecting multiple devices in accordance with this disclosure is within the spirit and scope of the invention.

FIGS. 10 through 32B depict a combination bag, mat, and floatation device 100*a*, according to an example embodiment. The combination bag, mat, and flotation device consist of a front panel 101*a*, a back panel 104*a*, a bottom panel 107*a*, a side panel 108*a*, a first inflatable panel 109*a*, a second inflatable panel 110*a*, and a first plurality of openings 111*a*. The front panel 101*a* has a front panel top portion 102*a* and a front panel bottom portion 103*a*. The back panel 104*a* has a back panel top portion 105*a* and a back panel bottom portion 106*a*. The bottom panel 107*a* is attached to the front panel bottom portion 103*a* and the back panel bottom portion 106*a*. The side panel 108*a* is attached to each side of the front and back panel. The first inflatable panel 109*a* is attached to the front panel top portion 102*a*, and the second inflatable panel 110*a* is attached to the back panel top portion 105*a*. The first plurality of openings 111*a* are located in the front panel top portion 102*a* and the back panel top portion 105*a*.

Generally the front panel 101*a* may be defined as the most frontward facing flat or curved component used to form a physical boundary between the accessories being stored inside the device and the outside environment. The front panel may be made from materials such as canvas, straw, polyester, nylon, cloth, polymeric materials, etc. The front panel may be formed from a single piece of material of several individual pieces joined or coupled together. The front panel may be manufactured from a variety of manufacturing processes such as punching, folding, sewing, casting, molding, etc. The front panel may be made from other materials and manufacturing processes and is within the spirit and scope of the present invention. Generally the front panel top portion 102*a* may be defined as the upper most, or highest, area of the front panel. More specifically, the front panel top portion abuts the first inflatable panel 109*a*. Within the first panel top portion there are a first plurality of openings 111*a*. Generally, the front panel bottom portion 103*a* may be defined as the lowest area of the front panel. More specifically, the front panel bottom portion abuts the bottom panel 107*a*.

Generally the back panel 104*a* may be defined as the most rearward facing flat or curved component used to form a physical boundary between the accessories being stored inside the device and the outside environment. The back panel may be made from and manufactured by the same materials and processes as the front panel. However the back panel may also be formed from different materials and processes than the front panel. The back panel bottom portion 106*a* abuts the bottom panel 107*a*, whereas the back panel top portion 105*a* includes a first plurality of openings 111*a*.

Generally the first plurality of openings may be defined as any opening located on the front panel top portion and back panel top portion. These openings may be used for handle attachment when in bag configuration, stake placement when in open configuration 123*a*, fastener placement when in seat configuration 134*a*, etc. The first plurality of openings may appear differently across multiple embodiments. For example is some embodiments the openings may be shaped differently, in other embodiments the openings may be grommeted. The first plurality of openings may be formed from manufacturing processes such as punching, cutting, and extruding, however other processes may also be used and are within the spirit and scope of the present invention.

The bottom panel 107*a* may generally be defined as the lowest flat or curved component used to form a physical boundary between the accessories being stored inside the device and the outside environment. Specifically, the bottom panel 107*a* is attached to the front panel bottom portion 103*a* and the back panel bottom portion 106*a*. The bottom panel is used to connect the front panel 101*a* and the back panel 104*a*, forming a continuous plane. The bottom panel may be made from the same materials and manufacturing processes as the front and back panels or the bottom panel may be made from a different material or manufacturing process. In bag configuration, the bottom panel is used to form a physical boundary between the accessories stored inside the bag and a surface such as sand or rocks. Therefore, ideally the bottom panel would be made from a stiff and sturdy material to form support and structure for the bag. However any material may be used and is within the spirit and the scope of the present invention.

Generally the side panel 108*a* may be defined as a flat or curved component located on each side of the device. More specifically, the side panel 108*a* attaches to each side of each of the front and back panels. In closed configuration, each of the side panels may attach to an adjacent side panel. In some embodiments, the side panel 108*a* may attach to both the front panel top portion 102*a* and the front panel bottom portion 103*a*. In other embodiments, the side panel may only attach to the front panel bottom portion 103*a*. The side panel may vary in width and length depending on operators preference. For example, an operator may have many accessories needing to be stored while the device is in bag configuration. In this circumstance it is likely the side panels will have a greater width than a bag storing a small amount of accessories. Another example the device having larger side panels, is the possibility of the operator wanting a larger area to sit on when in mat configuration. The larger the side panels, the more surface area the mat provides for an operator. A flap 114*a* is located proximate to the bottom panel 107*a* that is detached from the front panel and the back panel. The flap can be referenced clearly in FIGS. 23A through 23D.

In some embodiments, the side panels may be permanently attached to the front and back panels, however in other embodiments the side panel may be removable. The combination bag, mat, and flotation device, when in bag configuration 121*a*, consists of each side panel on the front panel being removably attached to an opposing side panel on the back panel. The side panels being removable allow the user to choose a specific size for a particular beach trip. The side panels may be attached by use of hook and loop elements, zippers, magnets, snap fasteners, threading or weaving of lace/rope, or other attaching elements, adhesives, or methods. The side panels may be formed from the same or different materials than the front, back, and bottom panels.

The first inflatable panel 109*a* may generally be defined as a component that expands as fluid flows into said component, being in attachment with the front panel top portion 102*a*. FIG. 21A and FIG. 21B clearly depict an example embodiment of the inflatable panel. The first inflatable panel may be made from materials such as polyvinyl chloride (PVC), vinyl, nylon, Neoprene/CSM, polyvinyl plastic, etc. and may be manufactured from a variety of different processes such as extrusion, molding, casting, punching, folding, thermoforming, vacuum forming, etc. Other materials and processes may also be used and are within the spirit and the scope of the present invention. The first inflatable panel may be used as head/foot support while in mat configuration, a floatation device when in seat configuration 134*a*, etc. The inflatable panel may appear differently in certain embodiments. For example, the inflatable panel may take the shape of a rectangle, oval, or any ornamental shape or design. The cubic volume of the inflated panel may vary depending on buoyancy required by the user when in seat/floatation configuration. A large adult may require a large inflatable panel when floating in a body of water, whereas a small child may require a much smaller inflatable panel to float above the water. The second inflatable panel 110*a* may be defined similarly to the first inflatable panel in such that it is a component that expands as fluid flows into said component, being attached to the back panel top portion 105*a*. The second inflatable panel may or may not be made from and produced from the same materials and processes as the first inflatable panel 109*a*. The uses of the second inflatable panel may or may not be the same as the first inflatable panel 109*a*.

Figure 21D:
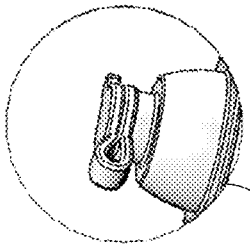
FIG. 21D is a detail view of an inflation nozzle, according to an example embodiment.
Figure 21C:
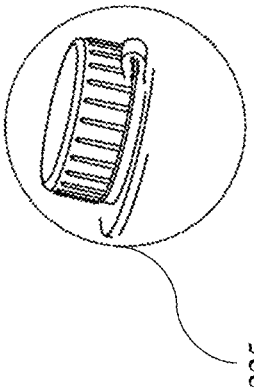
FIG. 21C is a detail view of an air nozzle exhaust valve, according to an example embodiment.
Figure 21B:
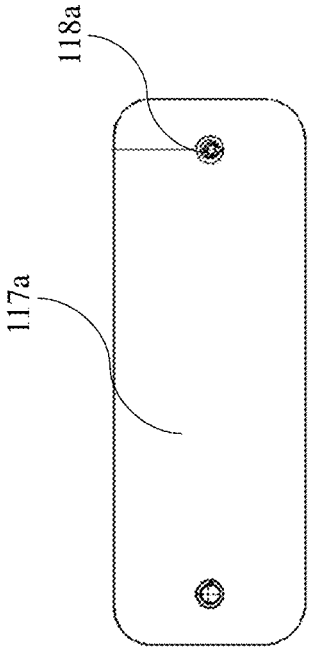
FIG. 21B is a top view thereof, according to an example embodiment.
Figure 21A:
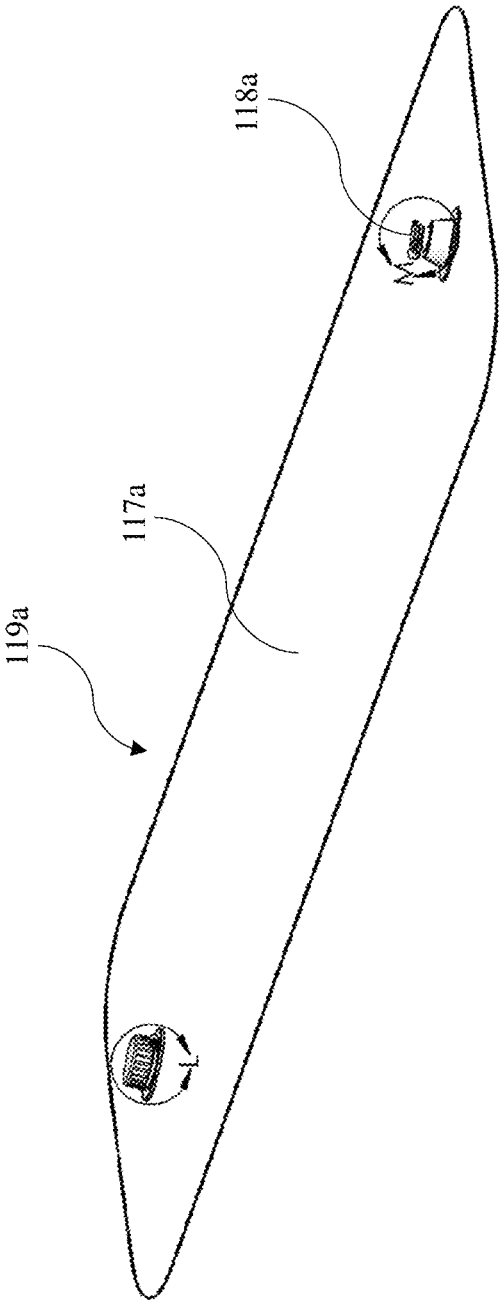
FIG. 21A is a perspective view of an inflatable reservoir having a nozzle located on a back side, according to an example embodiment.

Both first and second inflatable panels contain an inflatable reservoir 117*a* and a nozzle 118*a*, referenced in FIGS. 21A through 21D. The nozzle is located on a bottom side 119*a* of each inflatable panel for filling the inflatable compartment with air. The inflatable reservoir 117*a* may be made from materials such as polyvinyl chloride (PVC), vinyl, nylon, Neoprene/CSM, polyvinyl plastic, etc. and may be manufactured from a variety of different processes such as extrusion, molding, casting, punching, folding, thermoforming, vacuum forming, etc. Other materials and processes may also be used and are within the spirit and the scope of the present invention. Generally, the inflatable reservoir 117*a* may be defined as a compartment having the ability to expand volumetrically when fluid enters. As the user is filling the reservoir with air the inflated reservoir will expand in all directions forming a three dimensional shape. The shape of the inflatable reservoir may vary in other example embodiments. The nozzle 118*a*, used to fill the inflatable reservoir with air, may be one-way nozzles allowing air to pass through, shown by FIG. 21D. The nozzle may allow air to enter the inflatable reservoir such that the internal air compartment may inflate without letting air escape. FIG. 21C illustrates an example embodiment of a nozzle that may be used to release air from within the inflatable reservoir to outside the reservoir. The inflatable reservoir may be filled with air by inserting a manual or electric air pump into the nozzle and forcing air into the internal air compartment. Once inflated, the user may lay on the mat, using the inflatable panel as a pillow or headrest or footrest.

Figure 15:
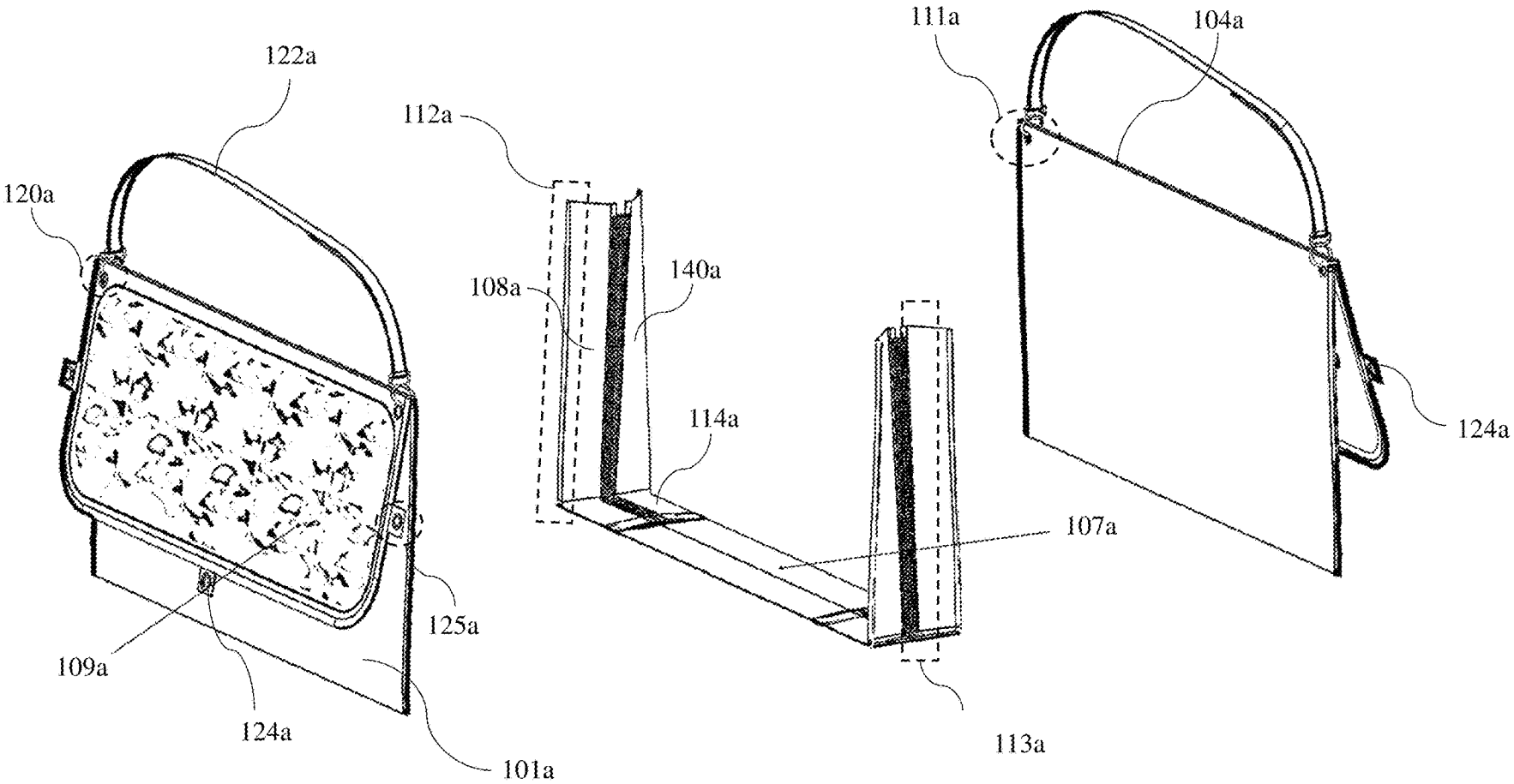
FIG. 15 is an exploded view of the second embodiment of the combination bag, mat, and flotation device in the bag configuration, according to an example embodiment.
Figure 16:
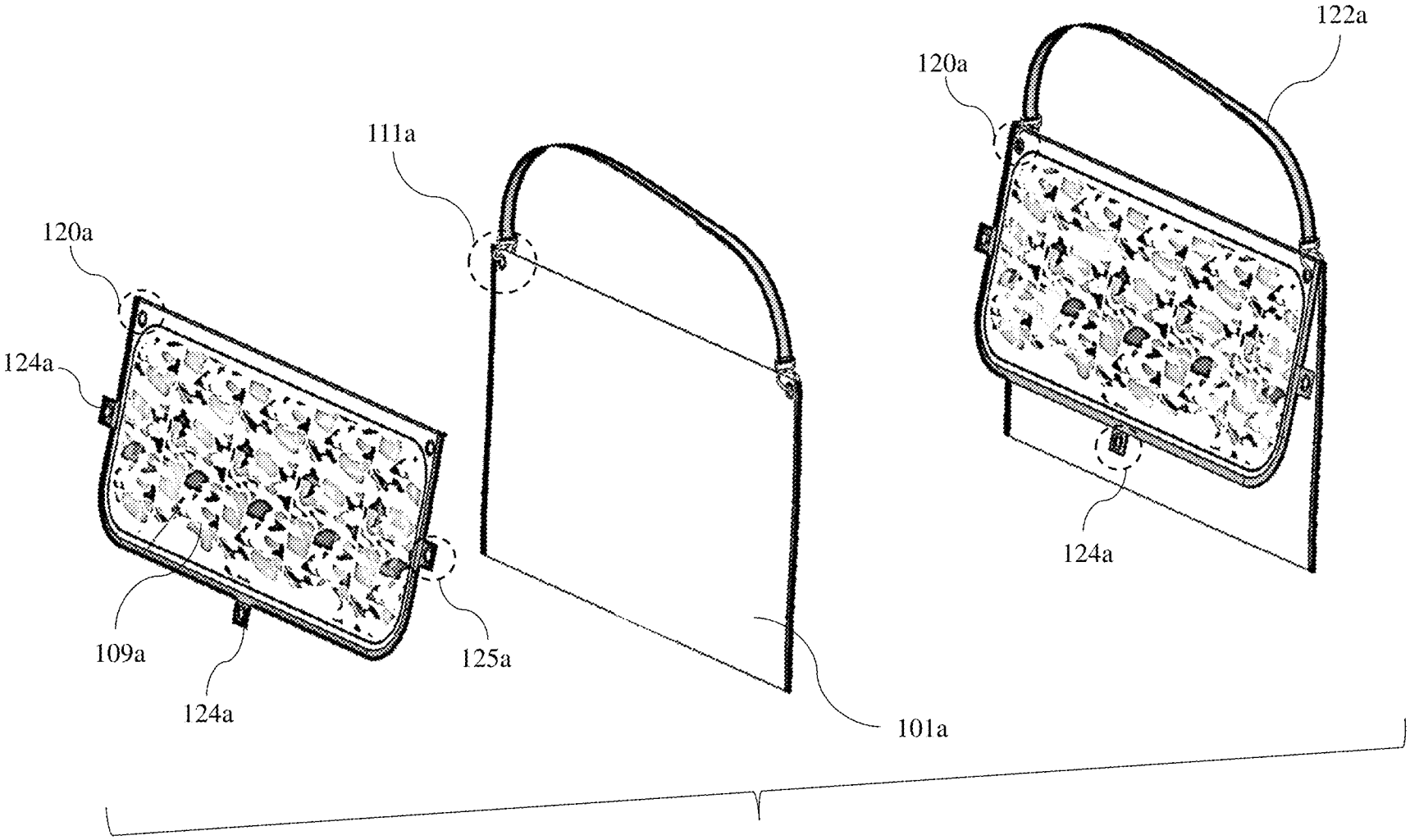
FIG. 16 is an exploded view of a front panel, an inflatable panel, and a handle of the second embodiment of the combination bag, mat, and flotation device according to an example embodiment.
Figure 17B:
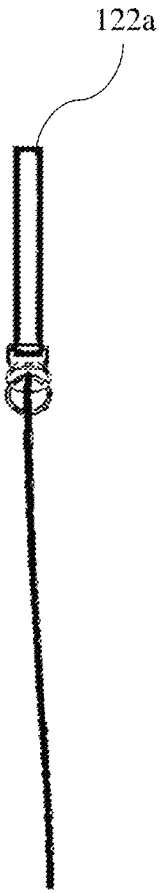
FIG. 17B is a side view thereof, according to an example embodiment.
Figure 17A:
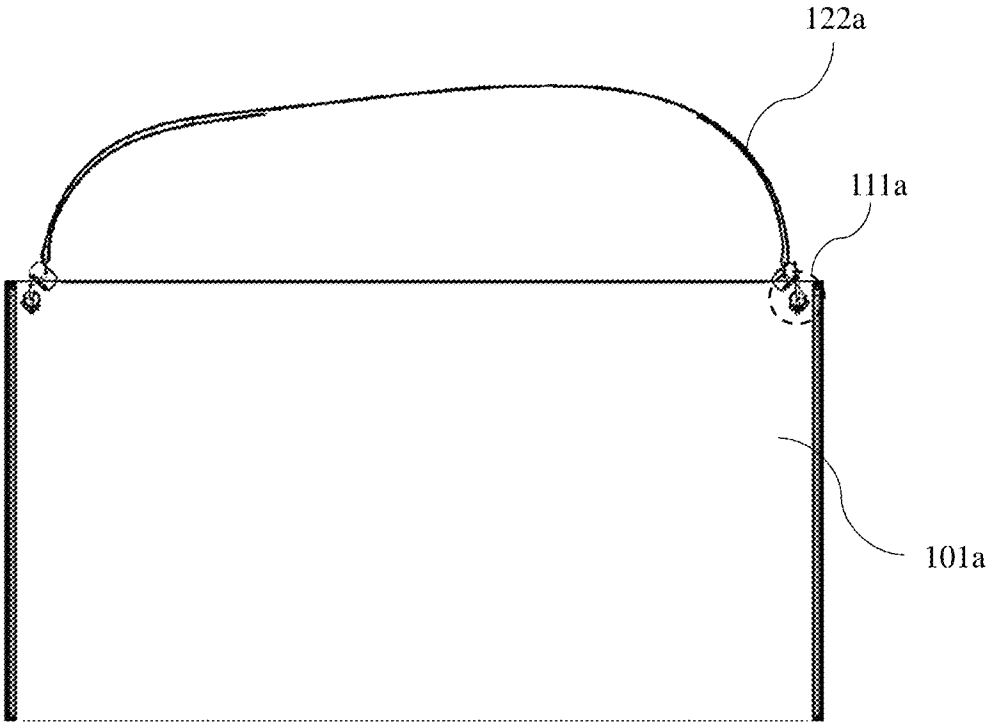
FIG. 17A is a front view of a front panel having a handle attached at a first plurality of openings of the second embodiment of the combination bag, mat, and flotation device, according to an example embodiment.
Figure 18:
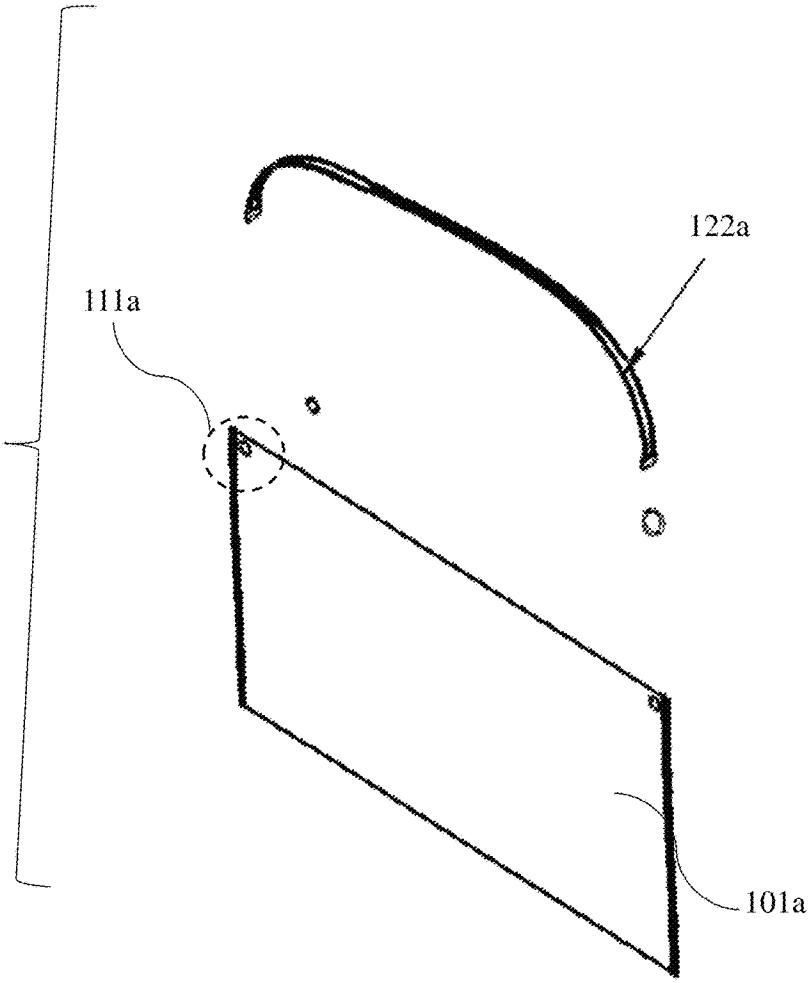
FIG. 18 is a front perspective view thereof, according to an example embodiment.
Figure 19B:
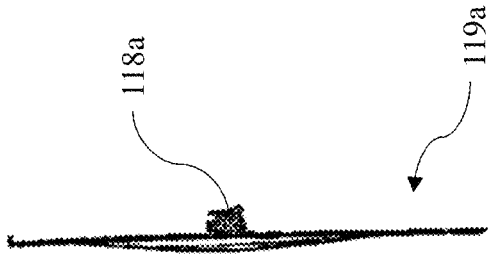
FIG. 19B is a side view thereof having a nozzle on a bottom side of the inflatable panel, according to an example embodiment.
Figure 19A:
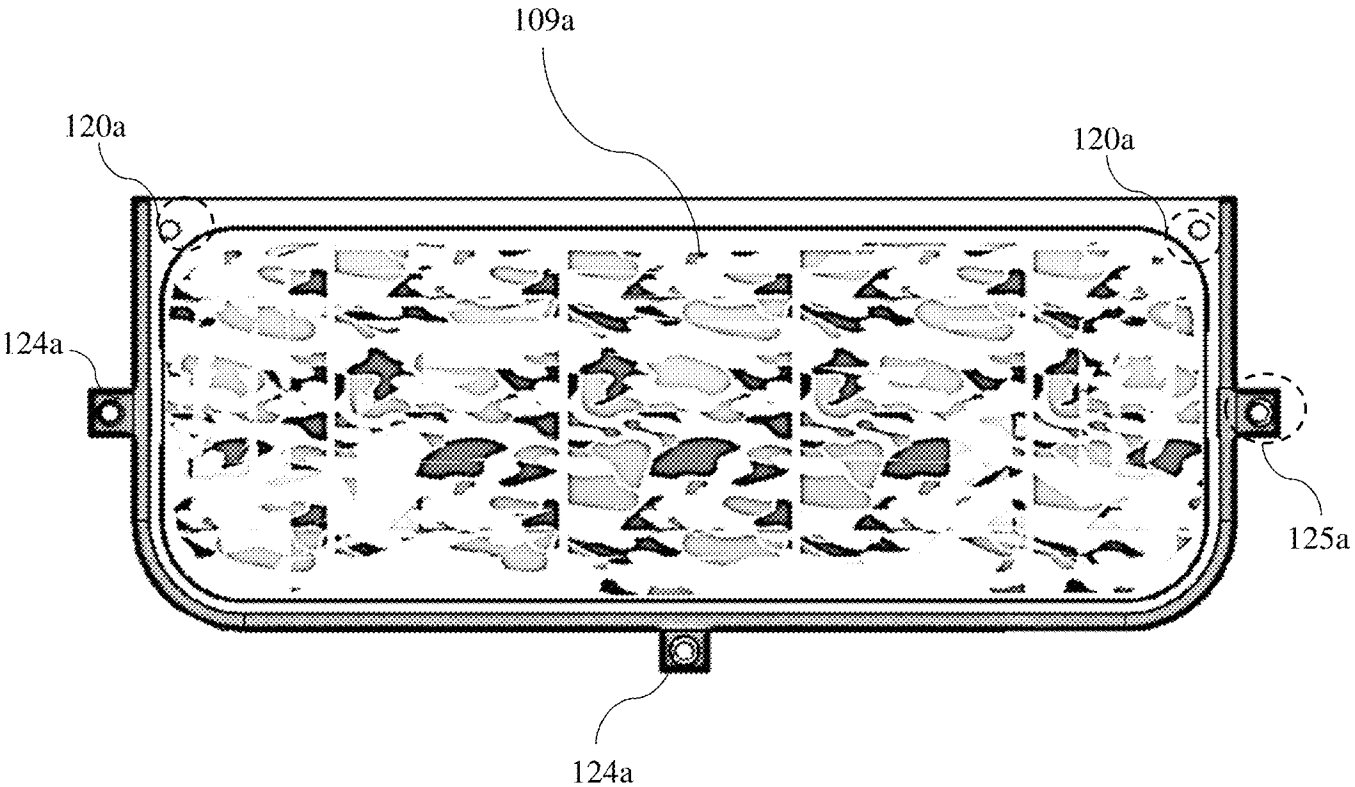
FIG. 19A is a front view of a first inflatable panel having a second plurality of openings and a plurality of tabs on the second embodiment of the combination bag, mat, and flotation device, according to an example embodiment.
Figure 20:
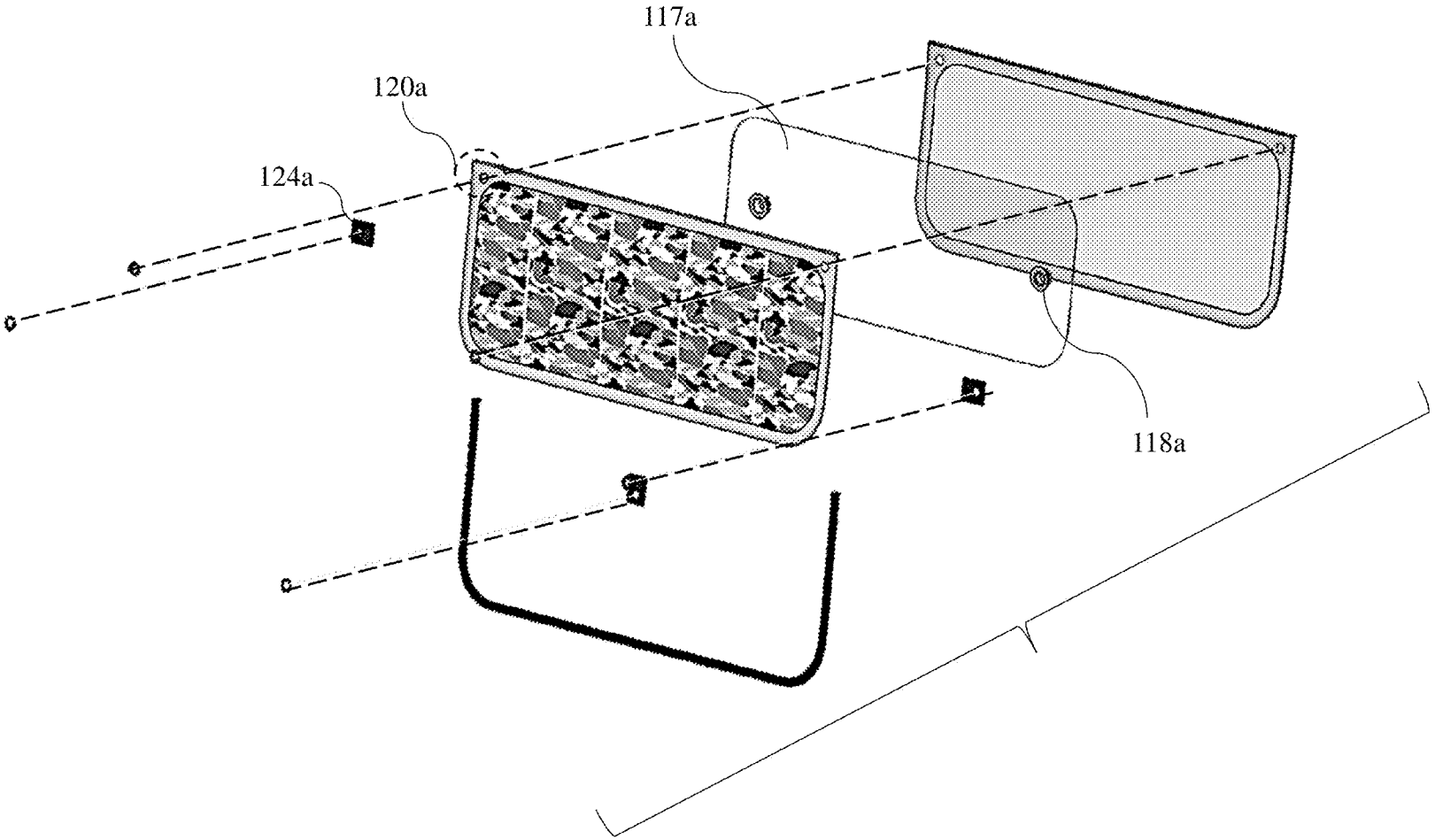
FIG. 20 is an exploded view of an inflatable panel having an inflatable reservoir.

The combination bag, mat, and flotation device further includes a second plurality of openings 120*a* in each the first inflatable panel 109*a* and the second inflatable panel 110*a* proximate to the respective top portion of the front panel and the back panel, and near the perimeter edge. In bag configuration 121*a* the second plurality of openings 120*a* align with the first plurality of openings 111*a*, as shown in FIG. 15. The alignment of the first and second plurality of openings, allows the user to fasten the front panel 101*a* with the first inflatable panel 109*a*. Ideally, the fastener will connect to a handle 122*a*, giving the user the ability to easily carry the device in the bag configuration.

When in bag configuration 121*a*, the combination bag, mat, and flotation device includes a handle 122*a* in attachment with the first plurality of openings and the second plurality of openings for carrying the combination bag, mat, and floatation device in the bag configuration. The handle may be in the form of a strap, a cord handle, a soft loop/trifold, tube, draw tape, die cut, rigid seal, etc. The handle may be fabric, wooden, metal, crocheted, straw, leather, rope, etc. The handle may be formed from a single piece of material or from two individual pieces joined or coupled together. The handle may be manufactured from a variety of manufacturing processes including extrusion, sewing, molding, casting, welding, shearing, punching, folding, 3D printing, CNC machining, etc. Other materials and manufacturing processes may also be used and are within the spirit and the scope of the present invention. In one example embodiment, the handle may be made from leather, taking the shape of an oval having a large surface area to be placed on a user's shoulder. In another example embodiment, the handle may be wood carved to fit a receiving hand.

Figure 22C:
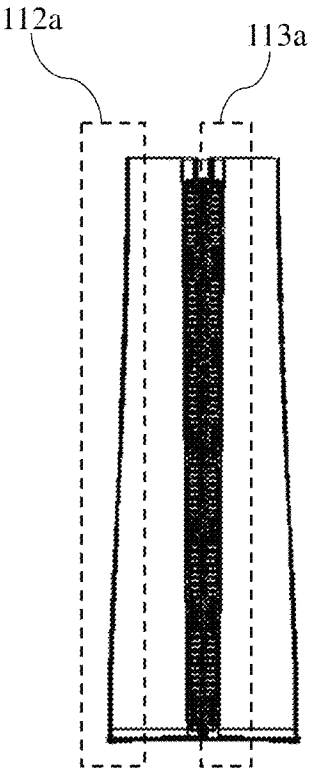
FIG. 22C is a side view thereof, according to an example embodiment.
Figure 22B:
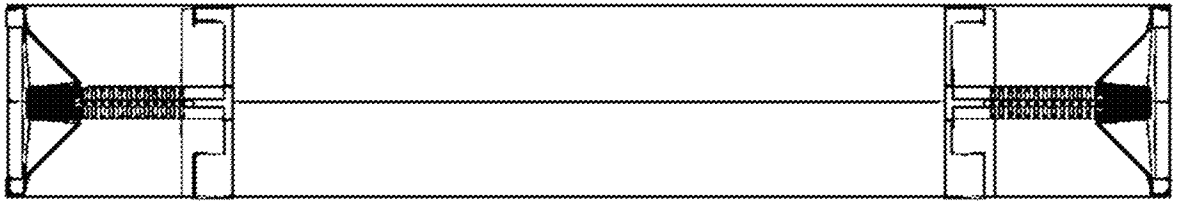
FIG. 22B is a top view thereof, according to an example embodiment.
Figure 22A:
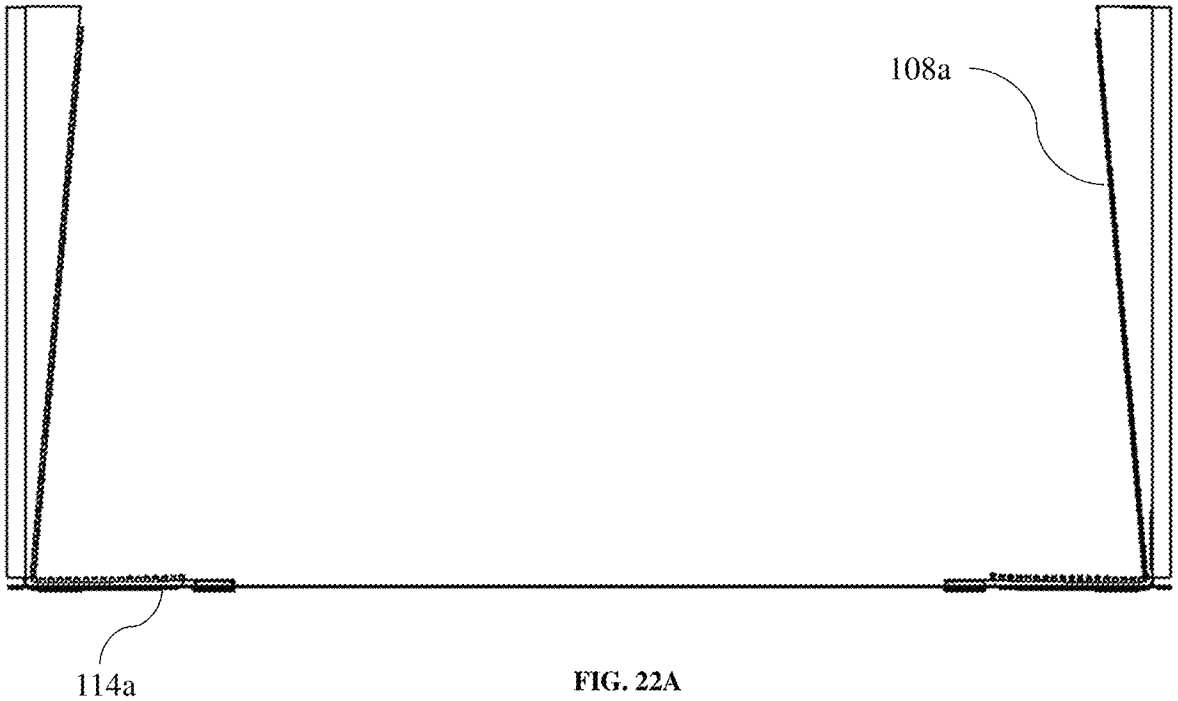
FIG. 22A is a front view of the side panels with a flap, according to an example embodiment.
Figure 23A:
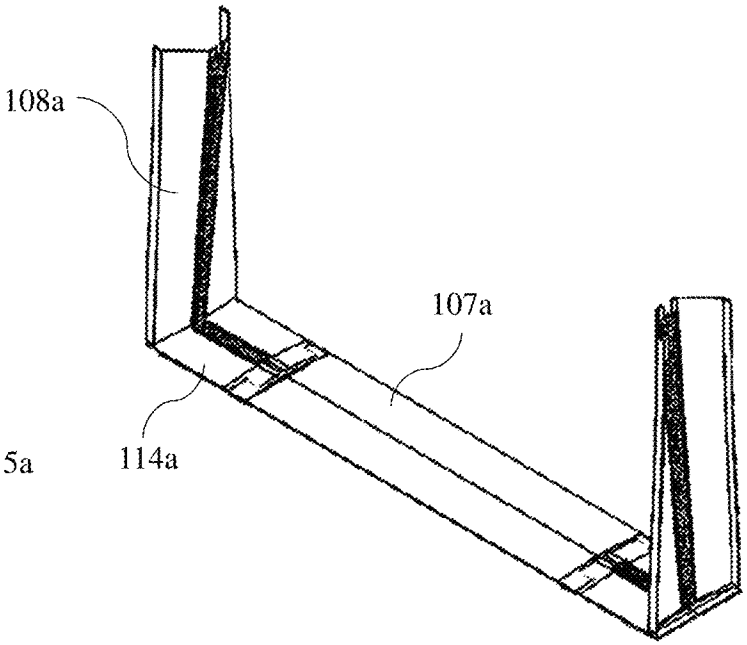
FIG. 23A is a perspective view of the side panels, flaps, and bottom panels in an assembled configuration of the second embodiment of the combination bag, mat, and flotation device, according to an example embodiment.
Figure 23D:
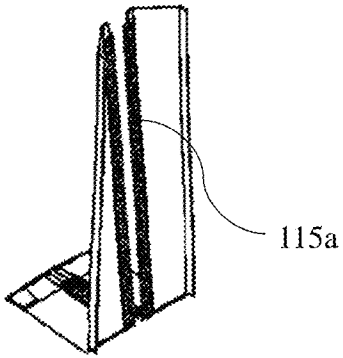
FIG. 23D is a perspective view of the side panels having flaps according to a second example embodiment.
Figure 23B:
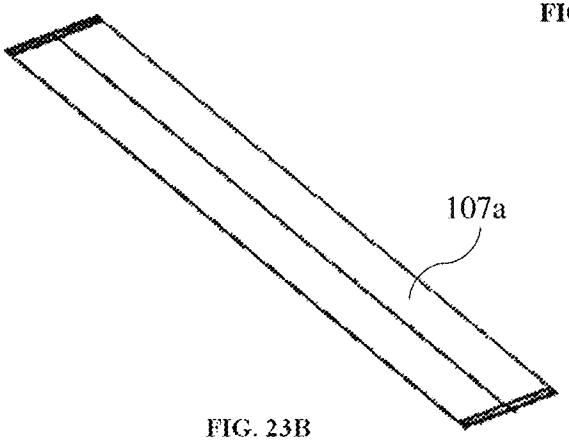
FIG. 23B is a perspective view of the bottom panels, according to an example embodiment.
Figure 23C:
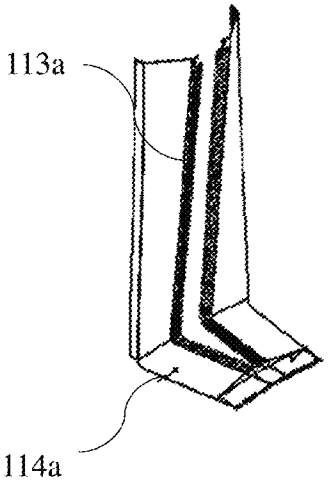
FIG. 23C is a perspective view of the side panels having flaps, according to an example embodiment.

The combination bag, mat, and floatation device 100*a* further comprises a first edge portion 112*a*, a fastening section 113*a*, and a flap 114*a* within the side panel 108*a*. The first edge portion 112*a* of the side panel 108*a* attaches to substantially all of the respective side of the front panel and all of the respective side of the back panel. The fastening section 113*a* of the side panel 108*a* is located opposite of the first edge portion for attaching a second side panel 140*a*, as shown more clearly in FIG. 15. The flap 114*a* is proximate to the bottom panel 107*a* that is detached from the front panel 101*a* and the back panel 104*a*. Proximate being defined as being close to or nearby, and substantially being defined as largely or greatly. FIG. 22A through FIG. 22C most clearly depict the side panels and the flap.

Generally, the first edge portion 112*a* may be defined as the edge of the side panel 108*a* in connection with the front or back panel. The first edge portion may be permanently attached to the front or back panel or may be removable. For example, the side panel may be sewn onto the front or back panel for security or structural preferences of the user. In other embodiments, the first edge portion may act as a fastener for the side panel, allowing the side panel to be removable. Some users may prefer having the side panel detachable in order to clean sand or rock from the device. In some embodiments the first edge portion may be in the form of a hook and loop fastener, in other embodiments the first edge portion may be made and formed from the material and processes as the rest of the side panel. Other materials and processes may also be used to form the first edge portion.

The fastening section 113*a* consists of at least one of a hook and loop element 115*a* and a zipper element 116*a*. In other embodiments, the fastening section 113*a* may utilize a plurality of fastening elements in addition to zippers and hook and loop elements, such as magnets, buttons, clips, ties, etc.. The purpose of the fastening section is to form a secure connection between a first and second side panel when in bag configuration. More specifically, the fastening section is configured to removably attach to the fastening section of the second side panel. By attaching two side panels, the device forms an enclosed compartment inside the device for storing and protecting accessories from the outside environment. Generally, the fastening section may be defined as the portion of a side panel 108*a* opposite of the first edge portion. More specifically, the fastening section may be defined as a securing element used to join a fist side panel with a second side panel.

Figure 12:
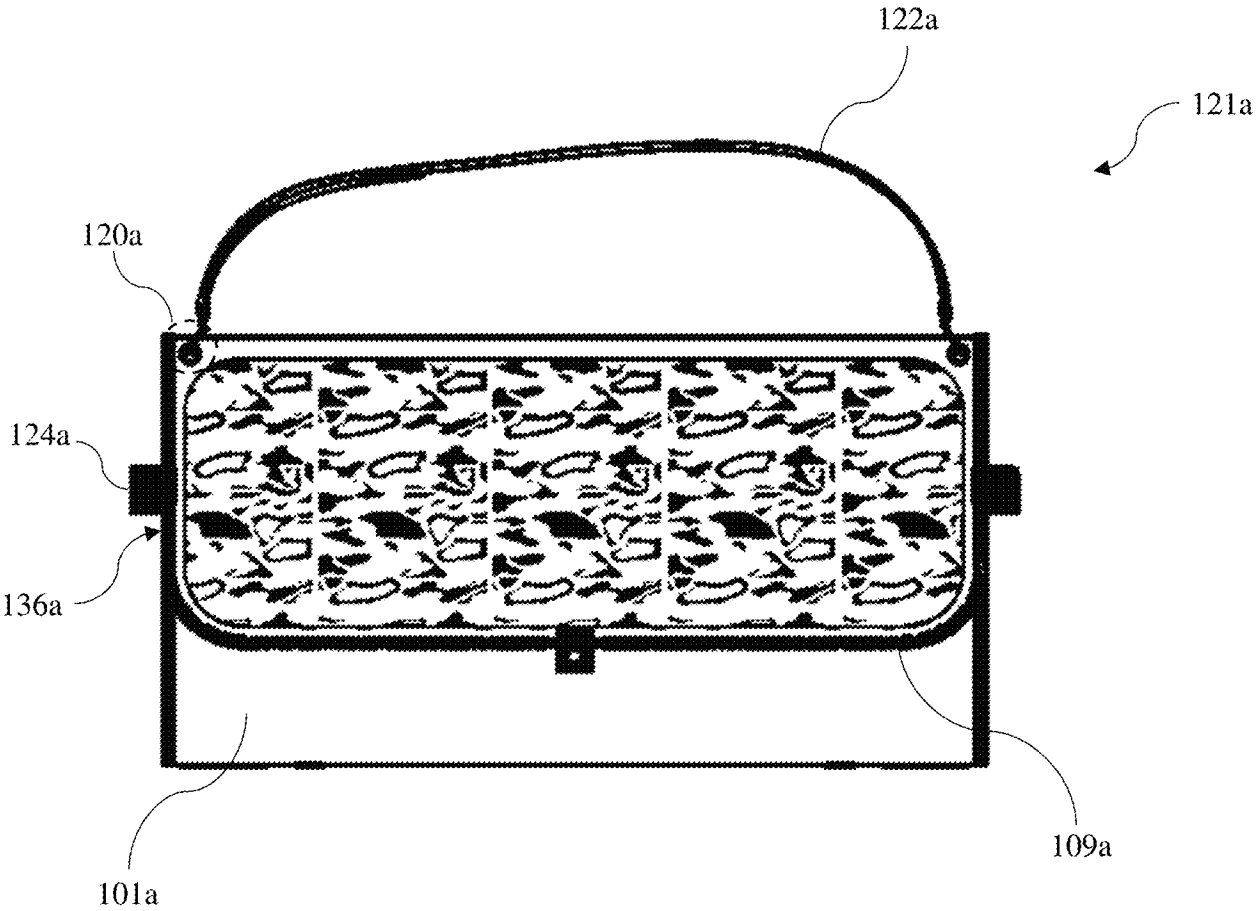
FIG. 12 is a front view of the second embodiment of the combination bag, mat, and flotation device in the bag configuration, according to an example embodiment.
Figures 13A, 13B, 13C:
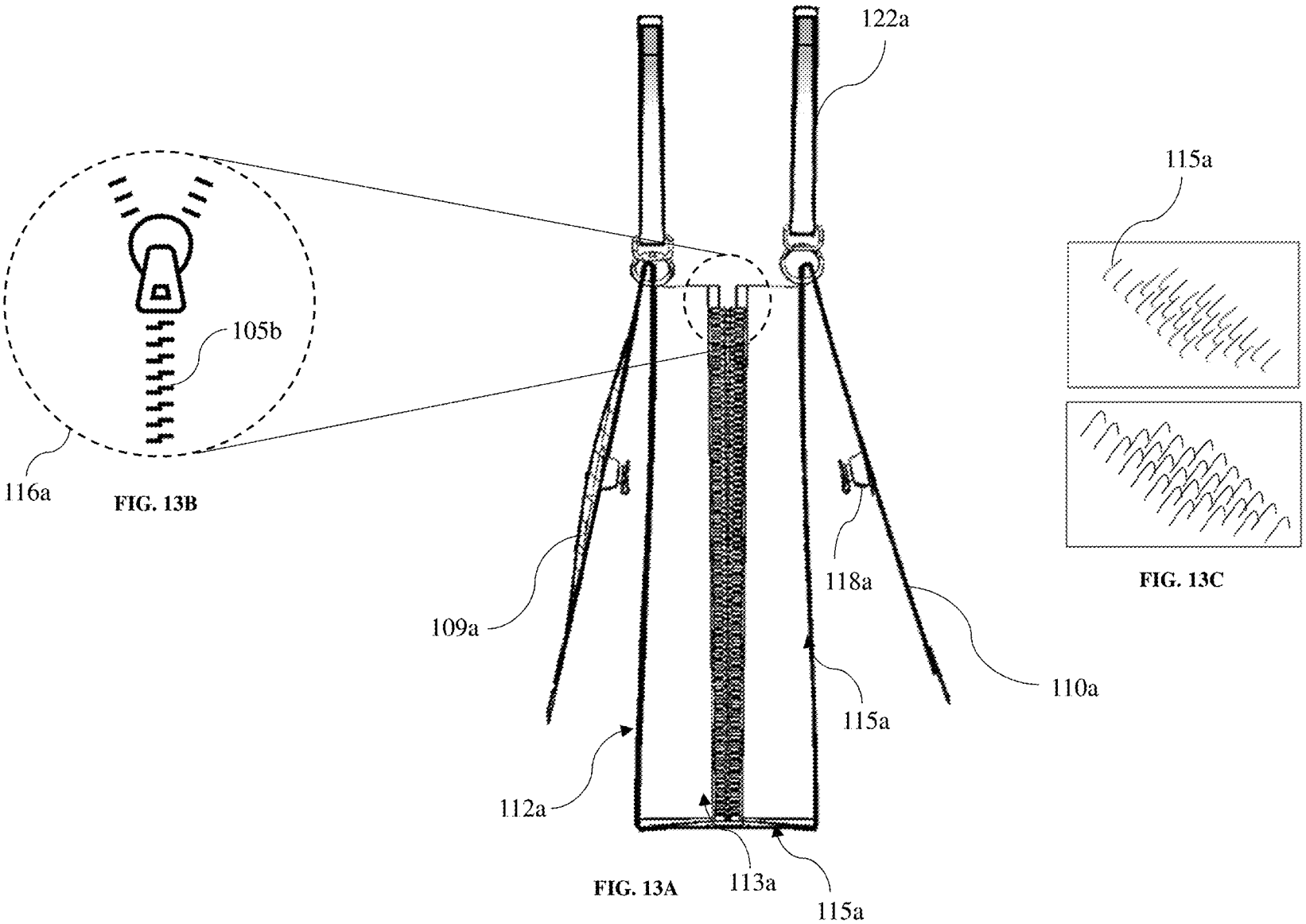
FIG. 13A is a side view of the second embodiment of the combination bag, mat, and flotation device in the bag configuration, according to an example embodiment.
FIG. 13B is a detail view of the zipper element of the second embodiment of the combination bag, mat, and flotation device, according to an example embodiment.
FIG. 13C is a detail view of the hook and loop element of the second embodiment of the combination bag, mat, and flotation device, according to an example embodiment.
Figure 14:
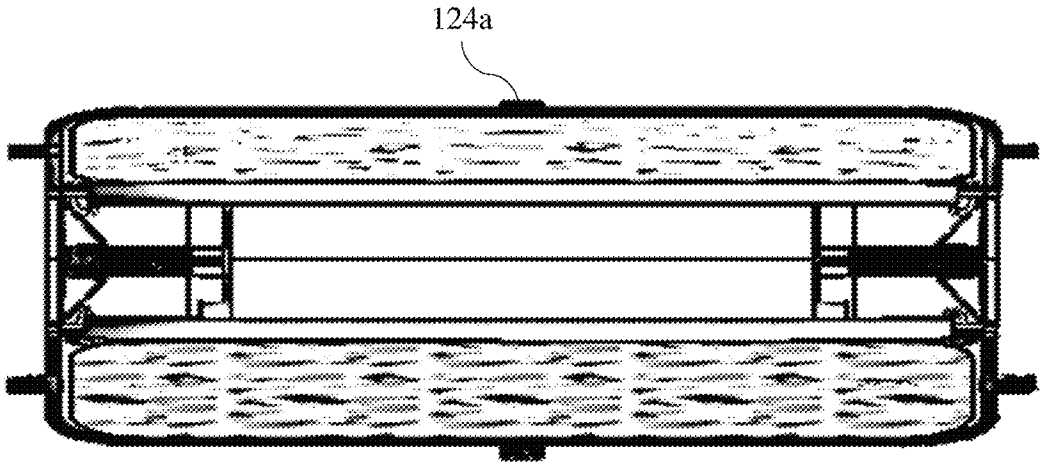
FIG. 14 is a top view of the second embodiment of the combination bag, mat, and flotation device in the bag configuration, according to an example embodiment.

The combination bag, mat, and floatation device further includes a mat configuration 133*a*. The mat configuration is defined by at least one of the side panels not being attached to the opposing side panel, illustrated in FIG. 24A. The combination bag, mat, and floatation device further consists of a plurality of tabs 124*a* extending from a perimeter edge 136*a*, as shown in FIG. 12, where the plurality of tabs extending from a perimeter include a third plurality of openings 125*a*.

The plurality of tabs 124*a* may be formed from the same material as the front and back panels or may be formed from a stronger material able to withstand repeated applied force. For example, in the seat configuration 134*a*, a device may be connected to another device, located adjacent to the first, being in a seat configuration. In operation, the user may fasten the plurality of tabs together by aligning the third plurality of openings of the first device with the third plurality of openings of the second device. Once aligned, the user may join the two tabs together by use of a securing element 708 such as hook and loop elements, clips, carabiners, rope, etc. Ideally, the tabs will need to be durable enough to endure harsh force, such as waves, while staying connected to one another. Embodiment 915, as shown in FIG. 9D and FIG. 9E, illustrates two devices in seat configuration being attached to one another. Furthermore, the tabs may be used as receptacles for certain accessories. For example, a user may attach the handle of a bottle of water to the tab while in seat configuration so that the bottle of water does not float away. The tabs extending from a perimeter edge may be used to hold things such as snorkels, goggles, sunglasses, etc. The third plurality of openings 125*a* may also be grommeted. The plurality of tabs provide great benefit over the prior art by allowing a user to easily attach a device to another device. The handle placement of certain floatation devices in the prior art require a user to thread a rope across multiple floats in awkward and undesirable locations. For example, the prior art shows river rafting tubes being connected to each other by rope having to be placed over peoples feet and legs and sometimes chest to fasten each raft together. The plurality of tabs prevent this by giving the user several options of where and how to fasten rafts or devices together. The tabs, described herein, are generally points where the attachments or second devices may be secured to the device. The tabs may extend from the perimeter of the bag, for example. Additionally, the tabs may be grommeted. Moreover, the tabs may be secured to any portion of any panel of the device to enable the device to attach to a foreign object, or second device. In certain embodiments, tabs may be complementarily positioned within the device to enable panels of the device to attach to other respective panels. For example, in such an embodiment, the tabs may be male and female fitting snap or friction fit grommets.

Figures 24A, 24B:
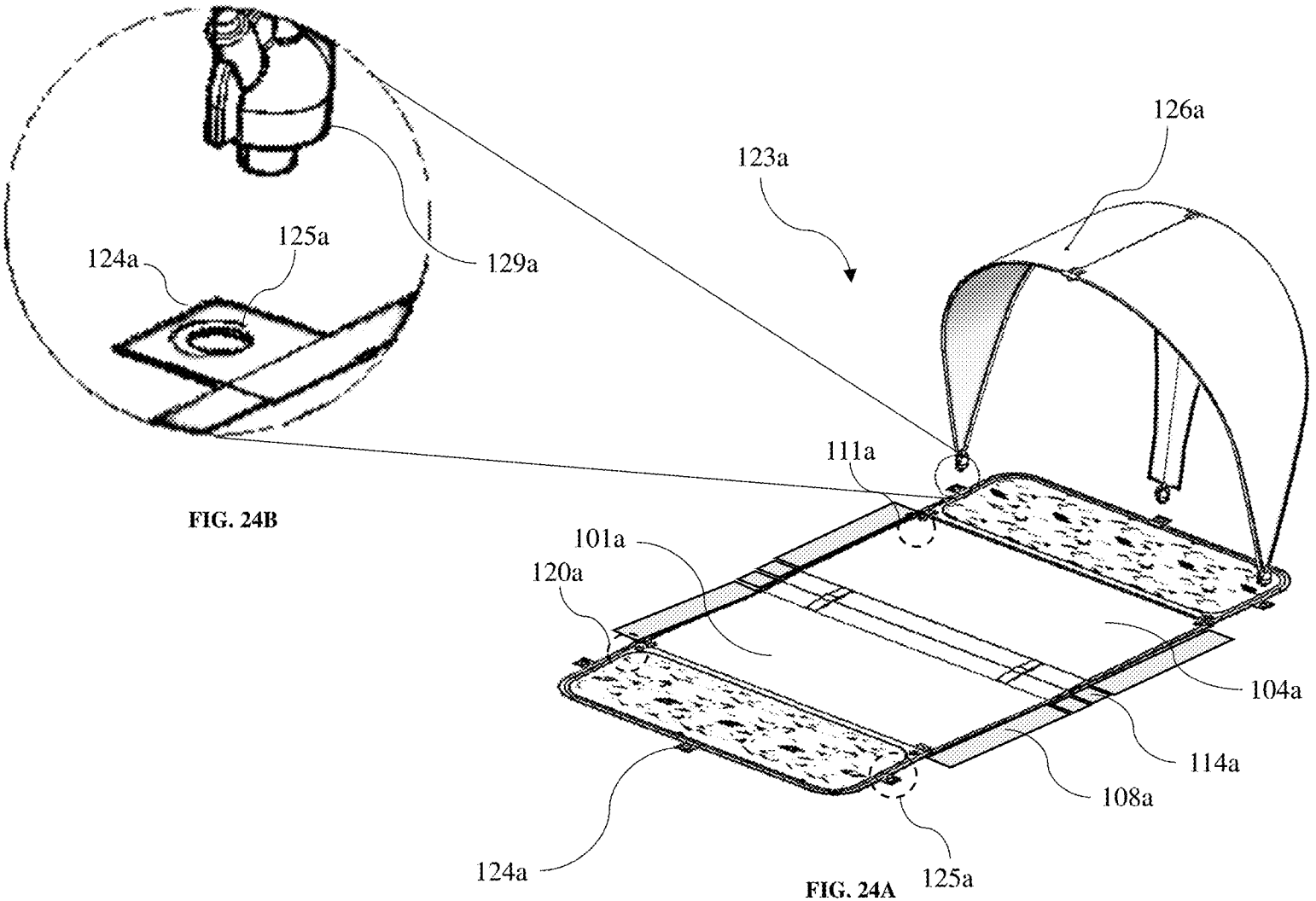
FIG. 24A is a perspective view of the combination bag, mat, and flotation device in the open configuration having a sunshade, according to an example embodiment.
FIG. 24B is a detail view of a tab and a fastener, according to an example embodiment.

The combination bag, mat, and floatation device further consists of a sunshade 126*a* in attachment with at least one of the first inflatable panel 109*a* and the second inflatable panel 110*a*. The sunshade includes a shade 127*a*, a frame structure 128*a*, and a fastener 129*a*. The fastener 129*a*, or side fastener, is adapted to be inserted into the third plurality of openings for securing the shade to the combination bag, mat, and floatation device. The sunshade is illustrated in FIGS. 24A through 27. FIG. 24A illustrates the combination bag, mat, and floatation device in the mat configuration 133*a*.

The sunshade 126*a* may generally be defined as a device used to protect an object or being from the sun's rays. More specifically, the sunshade blocks the sun's rays from reaching a user or item using the combination bag, mat, and floatation device in mat configuration. The sunshade may be in the form of a parasol or awning made from materials such as textile, pongee, taffeta, nylon, polyester, etc. When manufacturing the sunshade, a variety of different processes may be used such as extrusion, molding, sewing, folding, casting, 3D printing, etc. However, other materials and manufacturing processes may also be used and are within the spirit and the scope of the present invention. In one embodiment, the sunshade may be umbrella-like having a shaft, a canopy, and stretchers, made from a water proof materials such as nylon and polyester. In another embodiment the sunshade may be similar to a tent having a large planar material stretching from the ground surface up to an apex and back down to another ground surface.

The shade 127*a* may be defined as an object or material used to shield the user of the combination bag, mat, and floatation device from the sun's rays, providing an area being darker and cooler than the outside environment. In some embodiments, the shade may be made from an elastic material such as polyester and nylon. In other embodiments, the shade may be made from a stiff material such as vinyl or polyurethane. Depending on the users preference the shade may be small or large, and may be shaped circular like umbrellas, or rectangular like canopies. For example, if an operator was to use the combination bag, mat, and floatation device for themselves alone, they may only need a shade big enough to shield their body. Whereas, a family using the combination bag, mat, and floatation device, may need a larger shade to shield multiple children from the sun's rays. In reference to FIGS. 26B-26D, the shade 127*a* appears oval shaped from the top perspective, and triangular shaped from the side perspective.

Furthermore, the sunshade 126*a* includes a frame structure 128*a* used to provide shape and stability to the shade. The frame structure may be formed from a single piece of material or may be joined or coupled together. The material used for the frame structure may be durable such as carbon steel, stainless steel, aluminum, titanium, or other metals or alloys. In some embodiments the frame structure may be in the form of tent poles with shock cord or bungee strap linking each pole together. The frame structure may be curved forming a rounded shape with an apex oriented towards the sun or light source to disperse the rays. The frame structure may also resemble a rectangular prism creating a box like area for a user to be protected within. The sunshade 126*a* further includes a fastener 129*a* adapted to be inserted into the third plurality of openings located on the plurality of tabs extending from the perimeter edge. FIG. 24B depicts a fastener 129*a* being inserted through a third plurality of openings 125*a* located on the plurality of tabs 124*a* extending from a perimeter edge. The purpose of the side fastener is for securing the shade to the combination bag, mat, and floatation device. FIG. 28A through FIG. 30E depict several example embodiments of the fastener 129*a*.

Figure 32A:
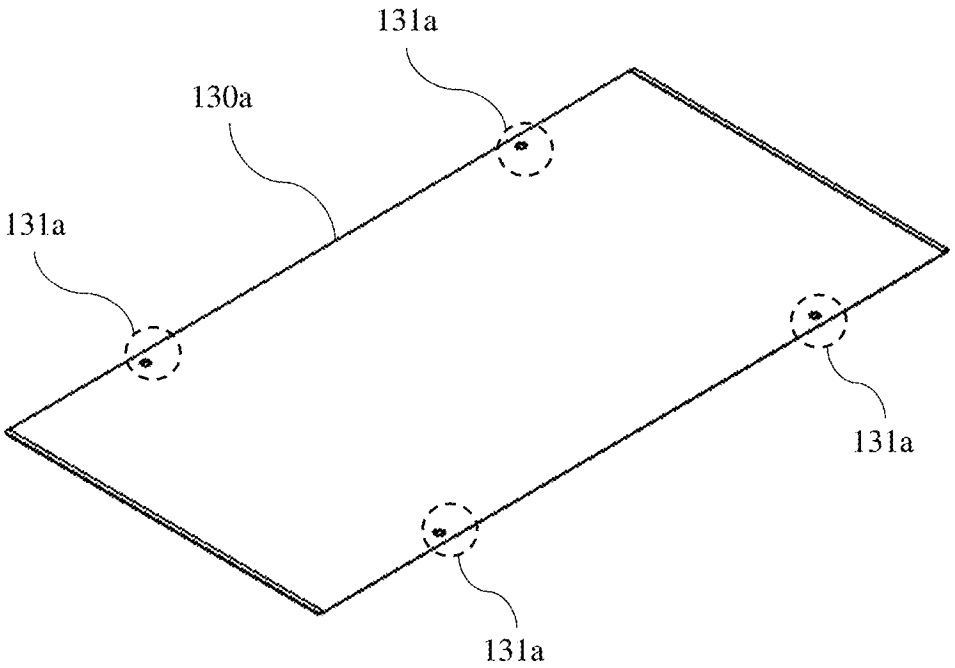
FIG. 32A is a perspective view of a mat having a fourth plurality of openings, according to an example embodiment.
Figure 32B:
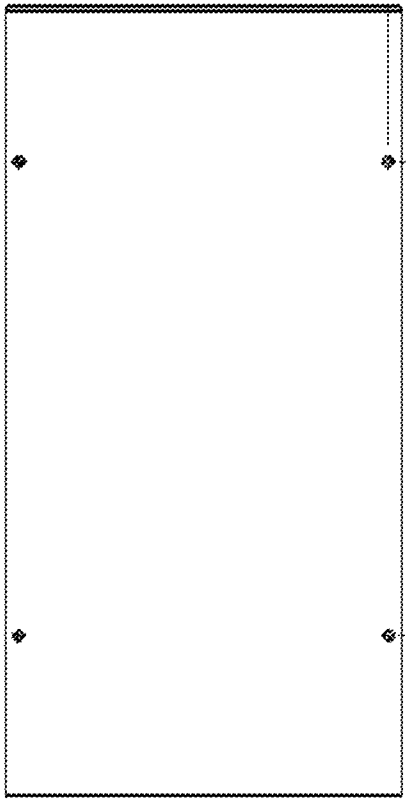
FIG. 32B is a top view thereof, according to an example embodiment.

The combination bag, mat, and floatation device includes a towel 130*a* having a fourth plurality of openings 131*a* which corresponds to at least the first plurality of openings of the combination bag, mat, and floatation device. An illustration of the towel, having a substantially planar body and having a fourth plurality of openings, is depicted in FIGS. 32A and 32B. Generally, the towel 130*a* may be defined as a piece of thick absorbent material typically used for drying oneself. More specifically, the towel is defined as an object or item used to form a physical barrier between the user and the ground that the combination bag, mat, and floatation device is being placed over. The towel may vary in size and shape dependent on the users preference. The towel may be formed from materials such as fabric, bamboo, polyester, nylon, foam, etc. Several different manufacturing processes may be used to create the towel such as extrusion, sewing, folding, molding, etc. Other materials and manufacturing processes may also be used and are within the spirit and the scope of the present invention. The fourth plurality of openings 131*a* may be similar to the first, second, and third plurality of openings, such that the openings may be grommeted, and may vary in size and shape.

Figure 25A:
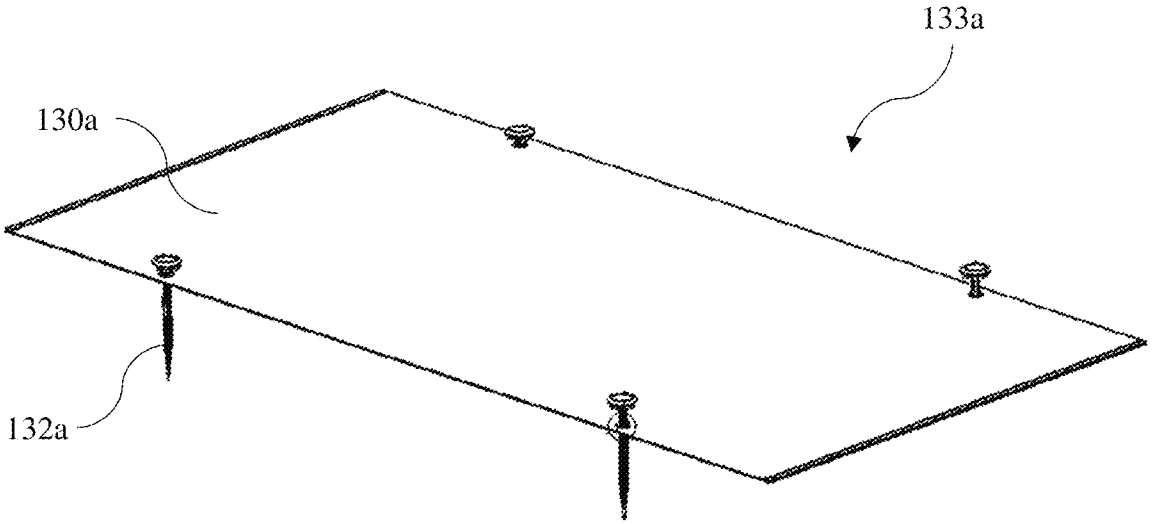
FIG. 25A is a perspective view of a mat having a plurality of stakes inserted, according to an example embodiment.
Figure 25B:
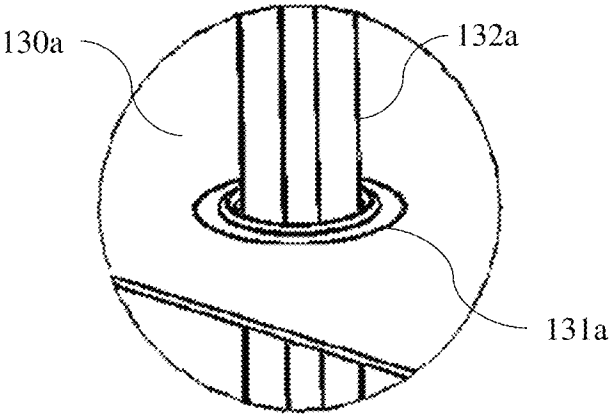
FIG. 25B is a detail view of a stake inserted within a fourth plurality of openings, according to an example embodiment.
Figure 26A:
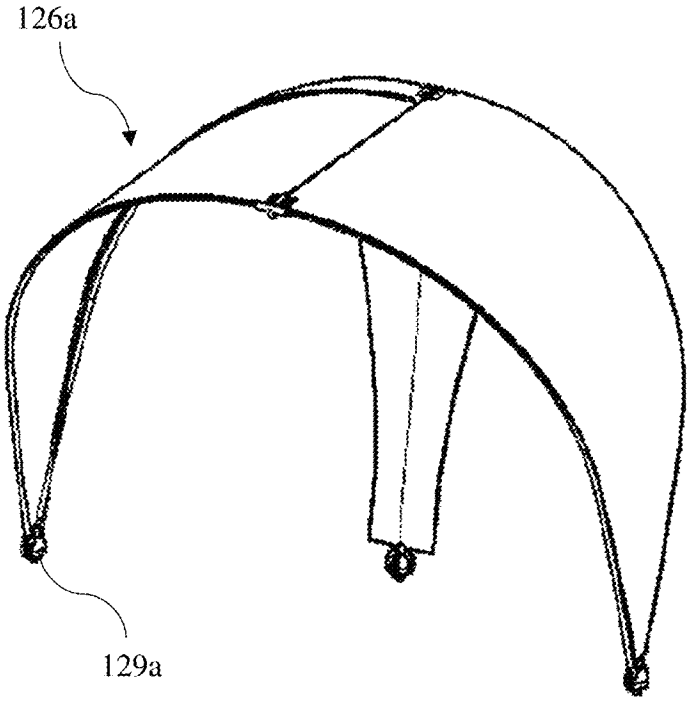
FIG. 26A is a perspective view of a sunshade, according to an example embodiment.
Figure 26B:
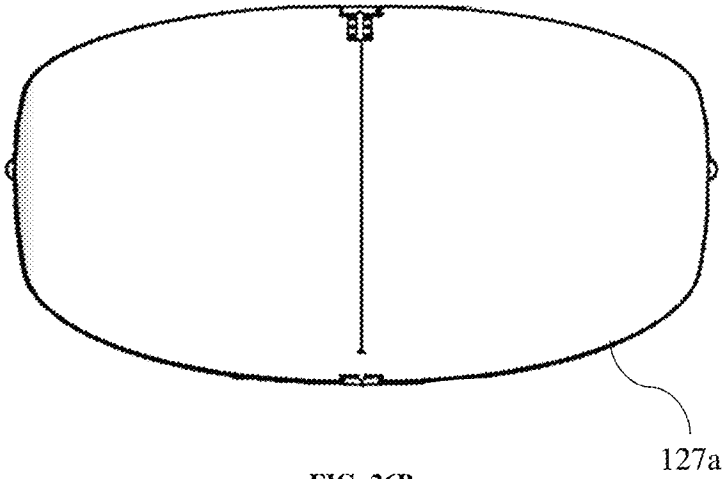
FIG. 26B is a top view thereof, according to an example embodiment.
Figure 26D:
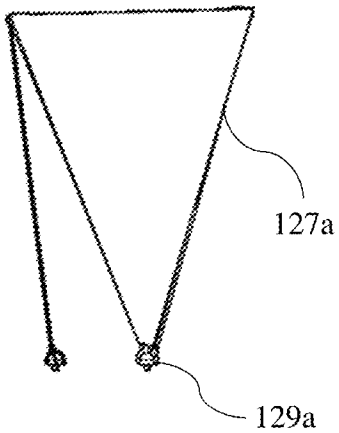
FIG. 26D is a side view thereof, according to an example embodiment.
Figure 26C:
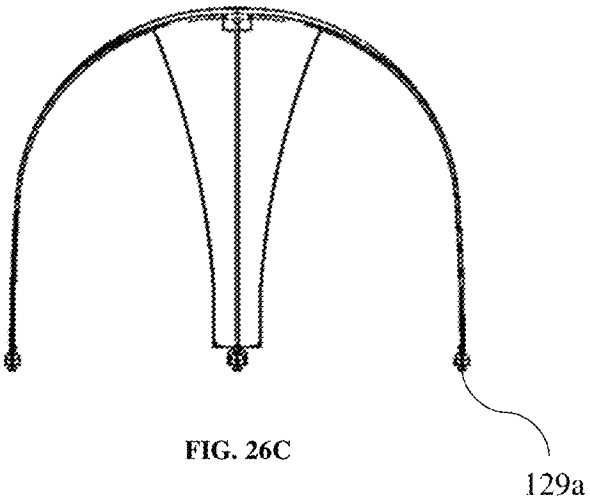
FIG. 26C is a front view thereof, according to an example embodiment.
Figure 27:
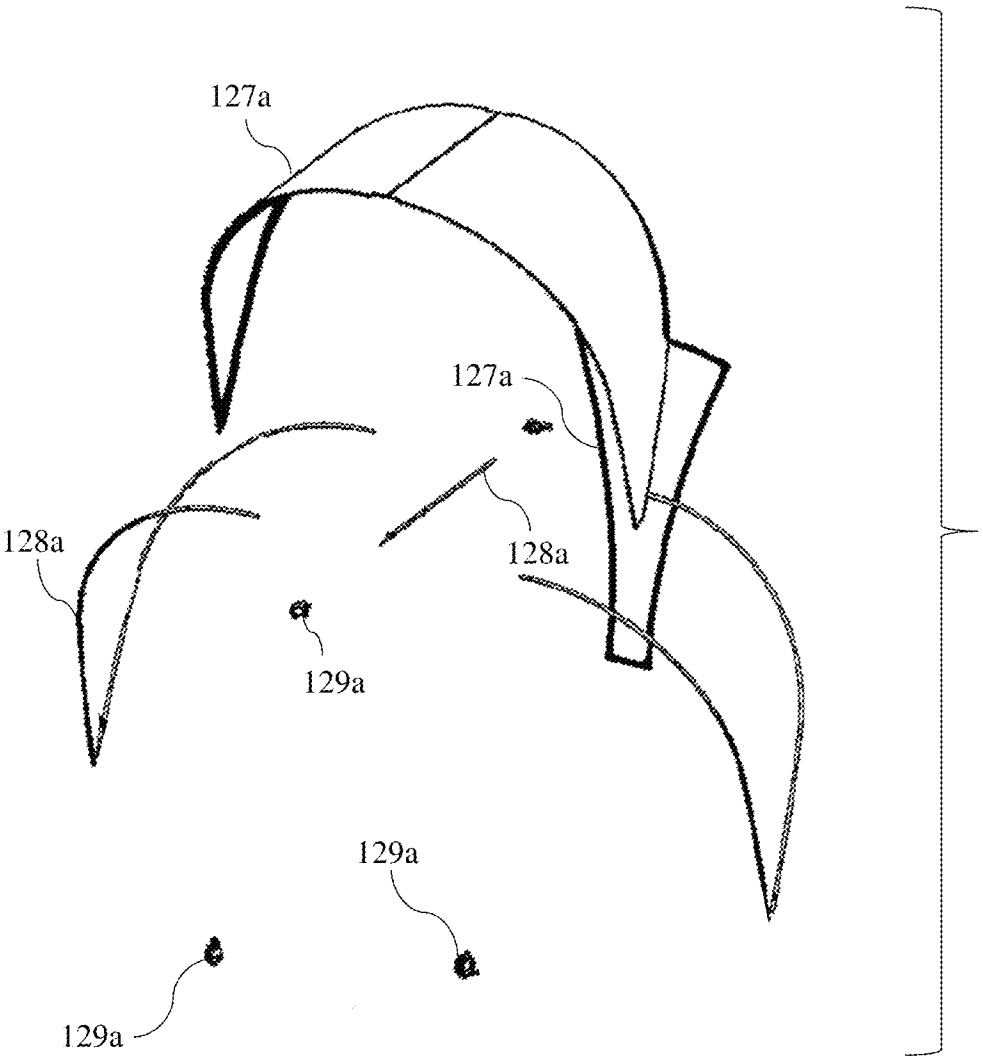
FIG. 27 is an exploded view of the sunshade, having a shade, a frame structure, and a fastener, according to an example embodiment.
Figure 28B:
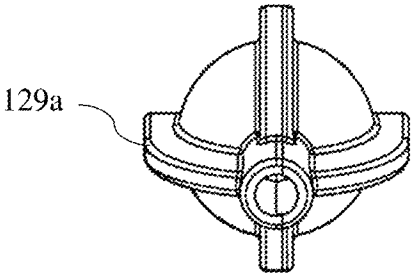
FIG. 28B is a top view thereof, according to an example embodiment.
Figure 28C:
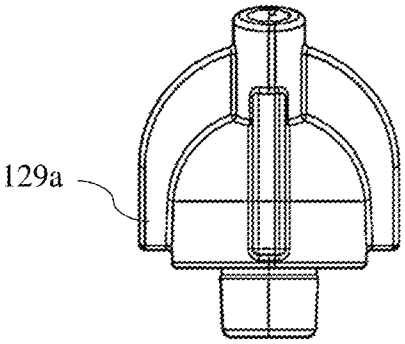
FIG. 28C is a front view thereof, according to an example embodiment.
Figure 28D:
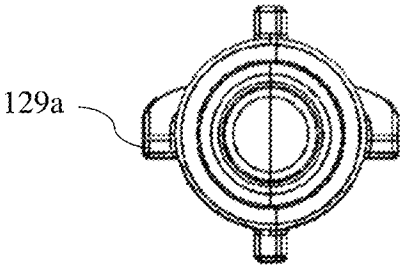
FIG. 28D is a bottom view thereof, according to an example embodiment.
Figure 28A:
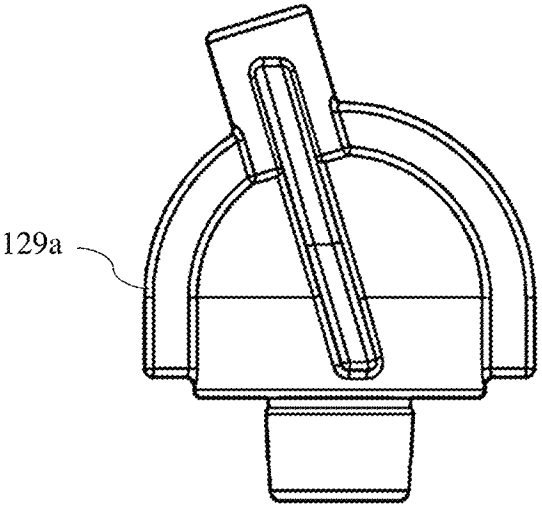
FIG. 28A is a side view of a fastener, according to an example embodiment.
Figure 29A:
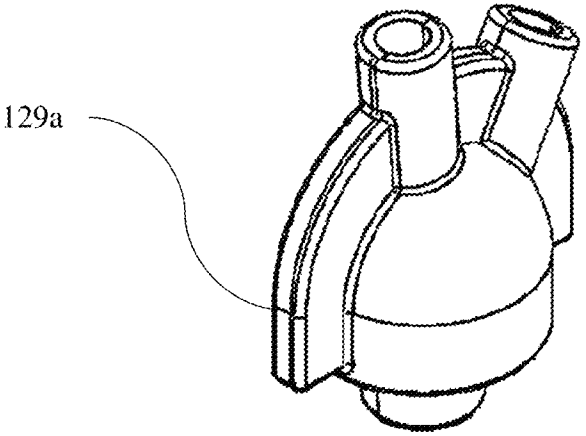
FIG. 29A is a perspective view of a second fastener, according to an example embodiment.
Figure 29B:
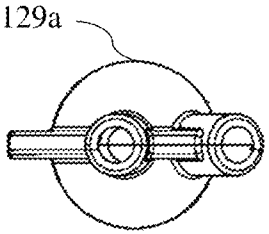
FIG. 29B is a top view thereof, according to an example embodiment.
Figure 29C:
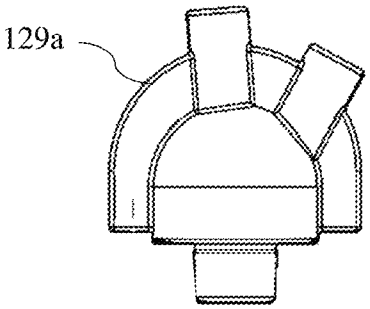
FIG. 29C is a front view thereof, according to an example embodiment.
Figure 29D:
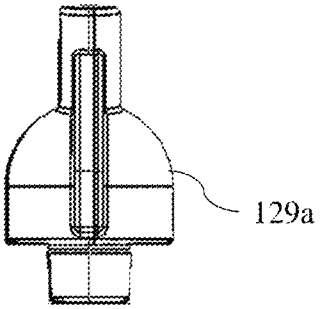
FIG. 29D is a side view thereof, according to an example embodiment.
Figure 30B:
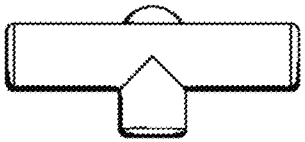
FIG. 30B is a front view thereof, according to an example embodiment.
Figure 30C:
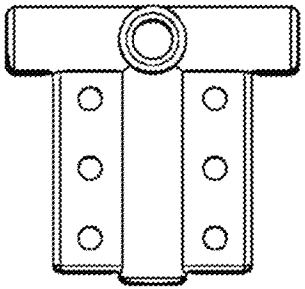
FIG. 30C is a bottom view thereof, according to an example embodiment.
Figure 30D:
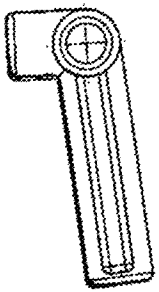
FIG. 30D is a side view thereof, according to an example embodiment.
Figure 30E:
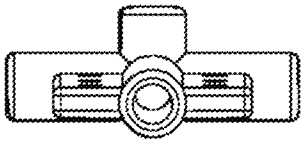
FIG. 30E is a back view thereof, according to an example embodiment.
Figure 30A:
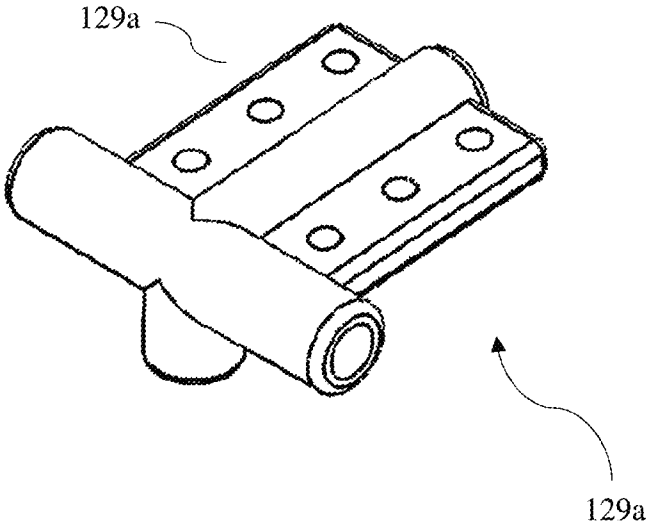
FIG. 30A is a perspective view of a third fastener, according to an example embodiment.
Figure 31A:
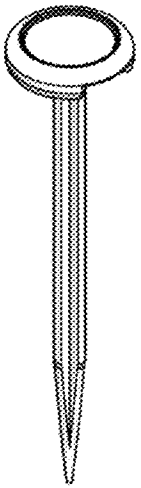
FIG. 31A is a perspective view of a stake, according to an example embodiment.
Figure 31C:
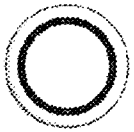
FIG. 31C is a top view thereof, according to an example embodiment.
Figure 31B:
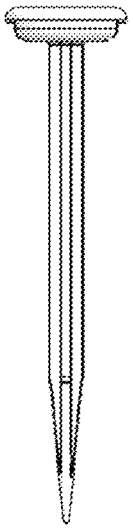
FIG. 31B is a side view thereof, according to an example embodiment.

A plurality of stakes 132*a* are also included in the combination bag, mat, and floatation device. The plurality of stakes are to be inserted through the fourth plurality of openings 131*a* and the first plurality of openings 111*a* to secure the combination bag, mat, and floatation device to the ground to define a mat configuration 133*a*. The plurality of stakes may be defined as strong wooden or metal posts having a point at one end to be driven into the ground. FIGS. 31A through FIG. 31C depict a first example embodiment of a stake. However, the size, shape, and material may vary in other example embodiments. For example, if a user would like to secure the device to a ground such as sand, the plurality of stakes may need to be longer than if the ground was tightly packed soil. FIGS. 25A and 25B illustrate the plurality of stakes 132*a* being inserted through the fourth plurality of openings 131*a* within a towel 130*a*.

As shown in FIG. 24A, in mat configuration 133*a*, all side panels are not attached to second side panels so that each of the side panels, the front panel 101*a*, the bottom panel 107*a*, and the back panel 104*a* are substantially flat, defining a substantially planar body. In operation, to reach mat configuration 133*a*, the user must first set the combination bag, mat, and floatation device on the ground having the bottom panel be in contact with said ground. Next, the user will need to detach the handle from both the first plurality of openings and the second plurality of openings. Next, the user will unfasten the side panels from each other. Once all side panels are disconnected from each other, the front panel and back panel should descend away from one another, towards the ground. As the front and back panels descend towards the ground, the user will need to grab the inflatable panels at the end farthest from the front panel top portion. The user will then pull the inflatable panel outwards away from the bottom panel allowing the inflatable panels to lay flat in contact with the ground. Once the front and back panels are lying flat on the ground, the side panels should lay flat, leaving all panels substantially flat against the ground. This may also be referred to as an open configuration. An open configuration 123*a* may be defined as when the mat has each of the side panels, the front panel, the bottom panel, and the back panel positioned such that the system defines a substantially planar body, as seen in FIG. 24A.

FIG. 8 illustrates an example embodiment of an inflated configuration having at least one of the first inflatable panel and the second inflatable panel each filled with air. In operation, a user will need to inflate each inflatable panel by locating the nozzle attached to the inflatable reservoir and begin pumping air through the nozzle. As mentioned before, a user may use a variety of methods and/or mechanisms when pumping air into the reservoir such as an electric pump, a manual pump, air compressors, etc. As the user inflates the reservoirs, the panels should be positioned so that the device defines a substantially planar body. Once the desired amount of air is trapped inside the inflatable reservoir, the user will need to close the nozzle to ensure no leakage of air. The combination bag, mat, and floatation device is now in the inflated configuration. Once inflated, the user may use the combination bag, mat, and floatation device as a floatie in the water or a lounge on the ground. For example, out of the water, the inflated configuration may be used to provide a head rest and/or foot rest for the user while in mat configuration, having the front and back panels positioned to define a substantially planar body. In another example embodiment, the user may inflate both first and second panels on several devices, then place the devices in a line, creating a trough-like area to place a child or baby.

When using the inflatable configuration in the water, a user may use the device as a seat having the front, back, and bottom panels provide a hammock to sit on while the inflatable panels, filled with air, keep the device afloat and provide arm rests. As shown in FIG. 8's example embodiment, the user may also connect the tabs of each inflatable panel to form an elongated inflatable panel and use such as a back rest when floating, this may also be referred to as a seat configuration 134*a*. A seat configuration 134*a* may be defined as having at least one of two adjacent side panels removably attached to each other on a first side of the device and two adjacent side panels unconnected on a second side of the device, and a first opening on the first side of the device and proximate to the front panel connected to a second opening on the first side of the device and proximate to the back panel using a fastener. Proximate may be defined as close to or near. Furthermore, the device can be oriented in an assembled configuration.

Figure 9C:
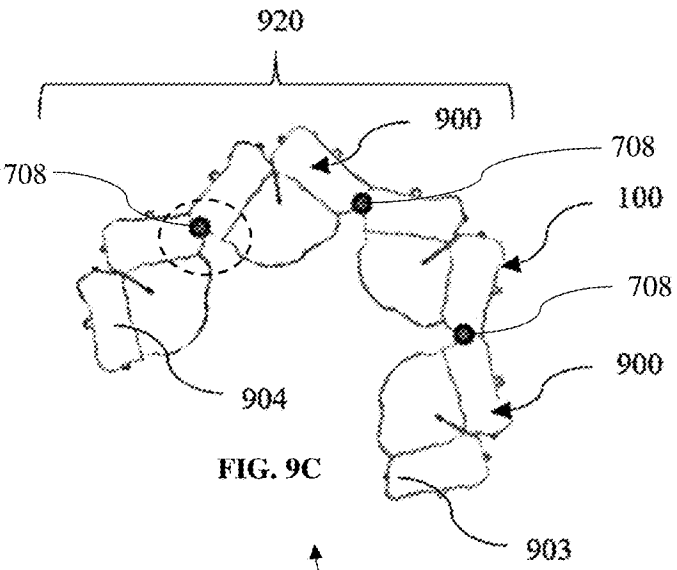
FIG. 9C is a perspective view of the combination bag, mat, and flotation device in the flotation device chair configuration connected to a second device in the flotation device chair configuration, according to a third example embodiment.
Figure 9A:
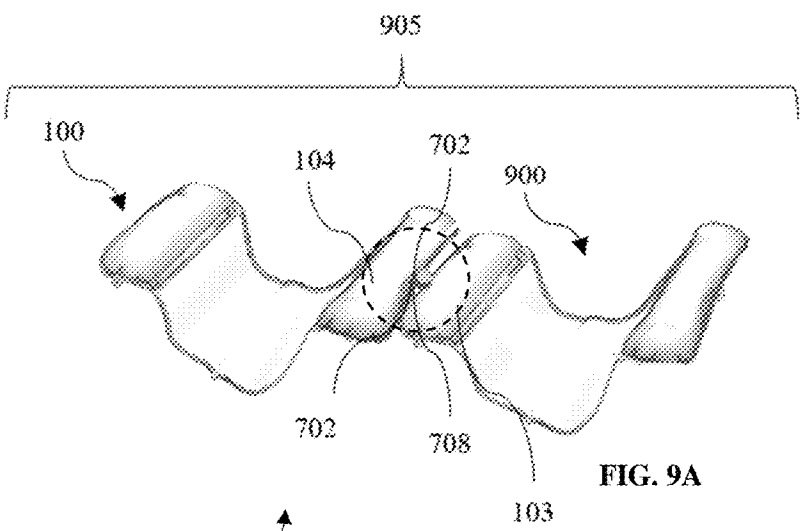
FIG. 9A is a perspective view of the combination bag, mat, and flotation device in the flotation device chair configuration connected to a second device in the flotation device chair configuration, according to a first example embodiment.
Figure 9B:
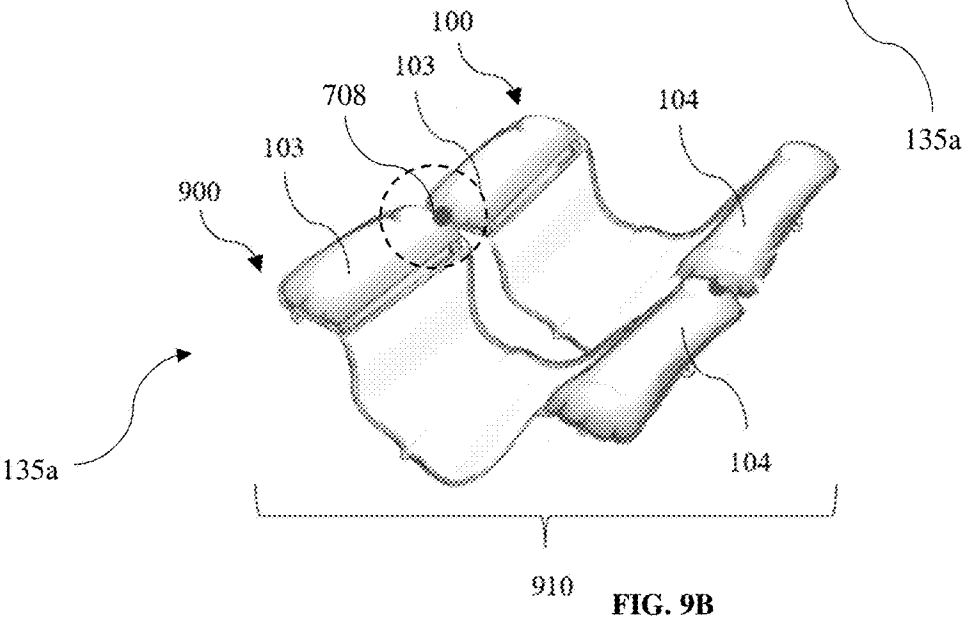
FIG. 9B is a perspective view of the combination bag, mat, and flotation device in the flotation device chair configuration connected to a second device in the flotation device chair configuration, according to a second example embodiment.
Figures 9D, 9E:
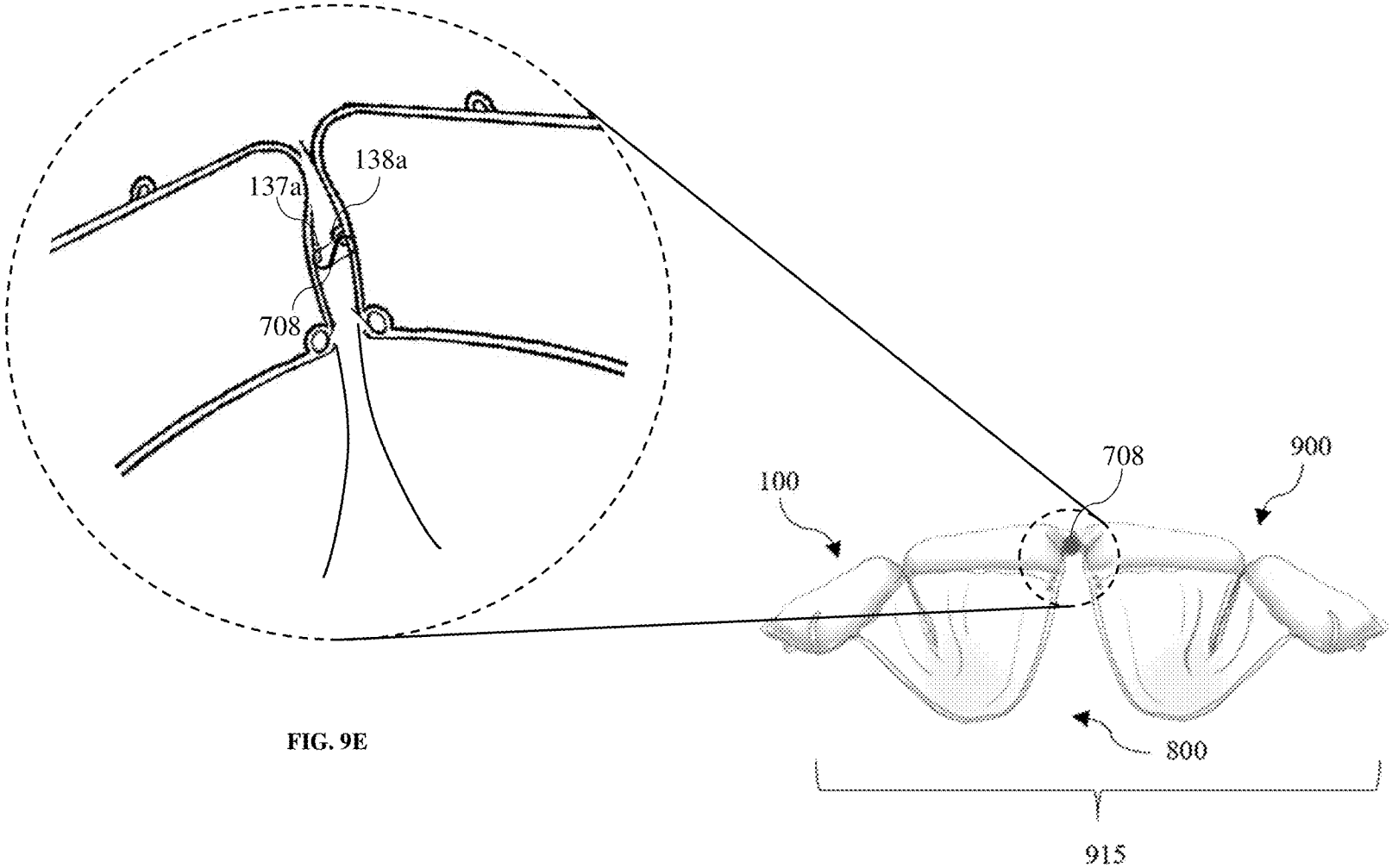
FIG. 9D is a perspective view of the combination bag, mat, and flotation device in the flotation device chair configuration connected to a plurality of second devices each in the flotation device chair configuration, according to a fourth example embodiment.
FIG. 9E is a detail view of the combination bag, mat, and flotation device in the flotation device chair configuration connected to a second device in the flotation device chair configuration through use of a securing element, according to a third example embodiment.

FIGS. 9A, 9B, and 9C illustrate an assembled configuration 135*a* consisting of a second combination bag, mat, and floatation device being removably attached to the combination bag, mat, and floatation device. When in assembled configuration 135*a*, a first tab 137*a* of the plurality of tabs of the combination bag, mat, and floatation device is removably attached to a second tab 138*a* of a plurality of second tabs of the second combination bag, mat, and floatation device using a fastener, side fastener, or the at least one securing element 405. FIG. 9A illustrates an example embodiment of an assembled configuration having two devices positioned adjacent to one another connected by use of a fastener joining the two tabs extending from the perimeter edge both located on the inflatable panels. FIG. 9B illustrates another example embodiment of an assembled configuration having two devices float parallel to each other. In this embodiment, the devices are joined by a second set of tabs located on the inflatable panels. FIG. 9C illustrates an example embodiment where multiple devices are attached to one another in assembled configuration. This example embodiment is most common with large groups of people or families wanting to float together without having to worry about one drifting off.

Figure 10:
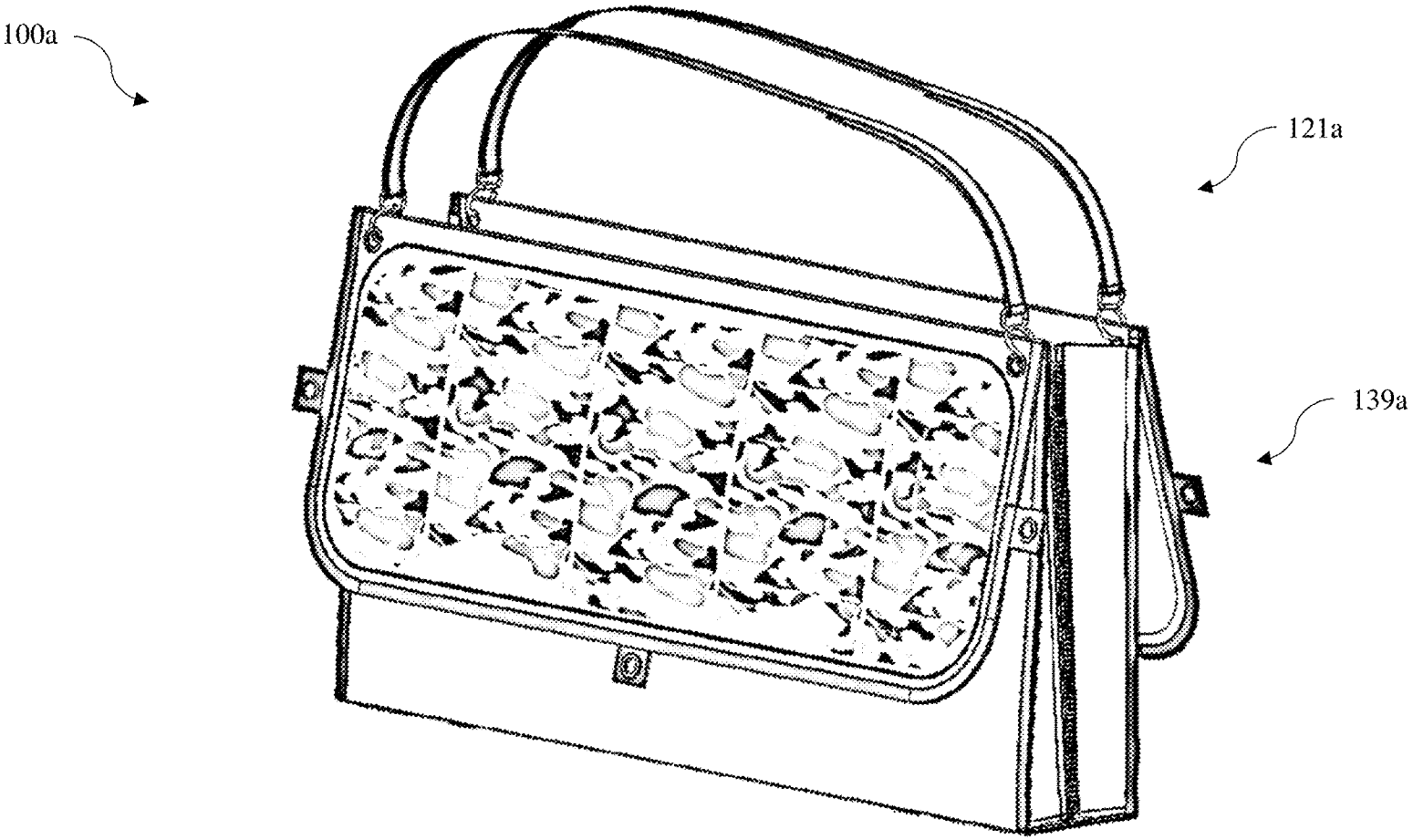
FIG. 10 is a perspective view of a second embodiment of a combination bag, mat, and flotation device in a bag configuration, according to an example embodiment.
Figure 11:
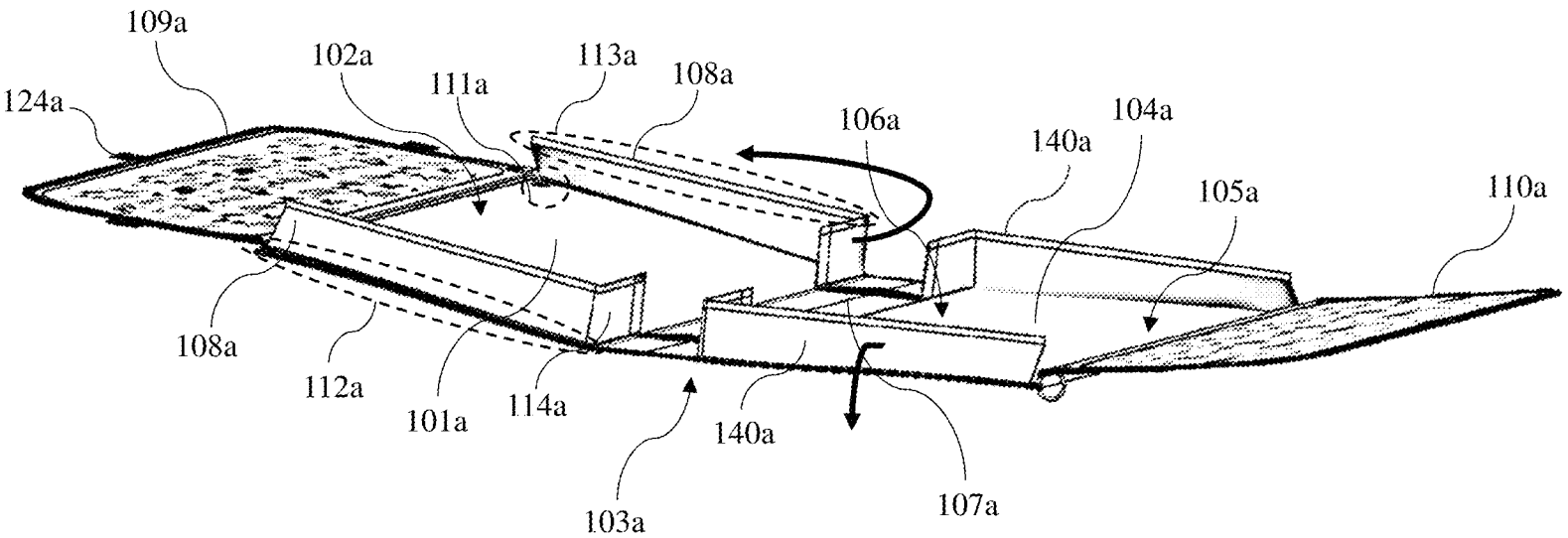
FIG. 11 is a perspective view perspective view of the second embodiment of the combination bag, mat, and flotation device in the open configuration, according to an example embodiment.

A closed configuration 139*a*, as shown in FIG. 10, consists of the bag having each of the side panels 108*a* being removably attached to an adjacent side panel of said plurality of panels and having the first inflatable section positioned next to the front panel 101*a*, and the bottom panel 107*a* positioned next to the second inflatable section. The closed configuration may also be referred to as the bag configuration 121*a*. The bag configuration allows the user to store all desired accessories inside the combination bag, mat, and floatation device when traveling to and from the destination. The bag configuration also helps keep everything compact and organized when driving to a location or packing up to go home. As mentioned before, the handle included in the device creates ease and comfort when carrying the device, ultimately allowing the user to give more of their energy to the occasion rather than the journey to the occasion.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

We claim:

1. A combination bag, mat, and flotation device assembly comprising:

a plurality of combination bag, mat, and flotation devices, wherein each combination bag, mat, and flotation device comprises:

a front panel having a front panel top portion and a front panel bottom portion;

a back panel having a back panel top portion and a back panel bottom portion;

a bottom panel having attached thereto the front panel bottom portion and the back panel bottom portion;

a removable side panel attached each side of each of the front panel and the back panel, a first inflatable panel attached to the front panel top portion;

a second inflatable panel attached to the back panel top portion;

a first plurality of openings in the front panel top portion and the back panel top portion;

a plurality of tabs extending from each of the first inflatable panel and the second inflatable panel, wherein the plurality of tabs comprises a second plurality of openings;

a flotation device configuration comprising:

a seat configuration comprising at least one of:

a first removable side panel removably attached to an adjacent second removable side panel on a first side of the combination bag, mat, and flotation device and a third removable side panels unconnected to an adjacent fourth removable side panel on a second side of the combination bag, mat, and flotation device;

a first opening of the first plurality of openings on the first side of the combination bag, mat, and flotation device and proximate to the front panel connected to a second opening of the first plurality of openings on the first side of the combination bag, mat, and flotation device and proximate to the back panel using a fastener;

wherein each of the first inflatable panel and the second inflatable panel are inflated;

an assembled configuration comprising at least one fastener connecting the plurality of combination bag, mat, and flotation devices, wherein each combination bag, mat, and flotation device is in the flotation device configuration, to each other such that the at least one fastener attaches the plurality of tabs of a first combination bag, mat, and flotation device in the flotation device configuration to the plurality of tabs of a second combination bag, mat, and flotation device;

a sunshade in attachment with at least one of the first inflatable panel and the second inflatable panel, wherein the sunshade comprises:

a shade;

a frame structure;

a fastener adapted to be inserted into the second plurality of openings for securing the shade to the combination bag, mat, and flotation device.

2. The combination bag, mat, and flotation device of claim 1 further comprising wherein each side panel comprises:

a first edge portion attached to one of (1) substantially all of respective sides of the front panel and (2) substantially all of respective sides of the back panel;

a fastening section opposite of the first edge portion for attaching to a second side panel; and a flap proximate to the bottom panel that is detached from the front panel and the back panel.

3. The combination bag, mat, and flotation device of claim 2 wherein the fastening section comprises at least one of a hook and loop element and a zipper element.

4. The combination bag, mat, and flotation device of claim 3 wherein each of the first inflatable panel and the second inflatable panel comprises:

an inflatable reservoir; and a nozzle disposed on a bottom side of each inflatable panel for filling the inflatable reservoir with air.

5. The combination bag, mat, and flotation device of claim 4 further comprising a third plurality of openings in each of the first inflatable panel and the second inflatable panel proximate to a respective top portion of the front panel and the back panel, and wherein the third plurality of openings aligns with the first plurality of openings in a bag configuration.

6. The combination bag, mat, and flotation device of claim 5 wherein the bag configuration comprises each side panel on the front panel is removably attached to an opposing side panel on the back panel.

7. The combination bag, mat, and flotation device of claim 6 wherein the bag configuration comprises a handle in attachment with the first plurality of openings and the third plurality of openings for carrying the combination bag, mat, and flotation device in the bag configuration.

8. The combination bag, mat, and flotation device of claim 1 further comprising a towel comprising a fourth plurality of openings corresponding to at least the first plurality of openings of the combination bag, mat, and flotation device.

9. The combination bag, mat, and flotation device of claim 8 further comprising a plurality of stakes to be inserted through the fourth plurality of openings and the first plurality of openings to secure the combination bag, mat, and flotation device to a ground to define a mat configuration;

wherein, in the mat configuration, all side panels are not attached to a second side panel of the combination bag, mat, and flotation device;

wherein, in the mat configuration, each of the side panels, the front panel, the bottom panel, and the back panel is substantially flat.

10. A system for providing a combination bag, mat, and flotation device comprising:

a front panel having a front panel top portion and a front panel bottom portion; and a back panel having a back panel top portion and a back panel bottom portion;

a bottom panel having attached thereto the front panel bottom portion and the back panel bottom portion;

a removable side panel attached to each side of each of the front panel and the back panel;

a first inflatable panel disposed proximate to the front panel top portion; and a second inflatable panel disposed proximate to the front panel top portion;

a closed configuration defining a bag configuration comprising by each of removable side panels being removably attached to an adjacent removable side panel of a plurality of removable side panels and having the first inflatable panel positioned next to the front panel, and the bottom panel positioned next to the second inflatable panel;

an open configuration defining a mat configuration comprising each of the removable side panels, the front panel, the bottom panel, and the back panel positioned such that the system defines a substantially planar body; and a sunshade in attachment with at least one of the first inflatable panel and the second inflatable panel, wherein the sunshade comprises:

a shade;

a frame structure; and a fastener adapted to be inserted into a second plurality of openings for securing the shade to the combination bag, mat, and flotation device.

11. The system for providing the combination bag, mat, and flotation device of claim 10 further comprising an assembled configuration comprising a second combination bag, mat, and flotation device removably attached to the combination bag, mat, and flotation device.

12. The system of claim 11 wherein the assembled configuration comprises each of the combination bag, mat, and flotation device and the second combination bag, mat, and flotation device in a seat configuration comprising at least one of:

a first removable side panel removably attached to an adjacent second removable side panel on a first side of the combination bag, mat, and flotation device and a third removable side panels unconnected to an adjacent fourth removable side panel on a second side of the combination bag, mat, and flotation device; and a first opening of a plurality of openings on the first side of the combination bag, mat, and flotation device and proximate to the front panel connected to a second opening of the plurality of openings on the first side of the combination bag, mat, and flotation device and proximate to the back panel using a fastener;

wherein each of the first inflatable panel and the second inflatable panel are inflated.

13. The system for providing the combination bag, mat, and flotation device of claim 10 further comprising a seat configuration comprising at least one of:

a first removable side panels removably attached to an adjacent second removable side panel on a first side of the combination bag, mat, and flotation device and a third removable side panels unconnected to an adjacent fourth removable side panel on a second side of the combination bag, mat, and flotation device; and a first opening on the first side of the combination bag, mat, and flotation device and proximate to the front panel connected to a second opening on the first side of the combination bag, mat, and flotation device and proximate to the back panel using a fastener.

14. A kit for providing a combination bag, mat, and flotation device comprising:

a combination bag, mat, and flotation device comprising:

a front panel having a front panel top portion and a front panel bottom portion;

a back panel having a back panel top portion and a back panel bottom portion;

a first inflatable panel attached to the front panel top portion;

a second inflatable panel attached to the front panel top portion; and a first plurality of openings on at least one of the front panel, the back panel, a first inflatable panel, and the second inflatable panel;

a towel comprising a second plurality of openings corresponding to the first plurality of openings of the combination bag, mat, and flotation device; and a sunshade configured to attach to at least one of the first inflatable panel and the second inflatable panel, wherein the sunshade comprises:

a shade;

a frame structure; and a fastener adapted to be inserted into at least one of the first plurality of openings and a third plurality of openings for securing the shade to the combination bag, mat, and flotation device.

15. The kit of claim 14 further wherein the combination bag, mat, and flotation device comprises a plurality of tabs extending from a perimeter edge of the combination bag, mat, and flotation device, wherein the plurality of tabs comprises a third plurality of openings.

16. The kit of claim 14 further comprising a handle configured to attach to the first plurality of openings for carrying the combination bag, mat, and flotation device in a bag configuration.

17. The kit of claim 14 further comprising a plurality of stakes to be inserted through the second plurality of openings of the towel and the first plurality of openings of the combination bag, mat, and flotation device to secure the combination bag, mat, and flotation device to a ground to define a mat configuration.

18. The kit of claim 17 further comprising an assembled configuration comprising a plurality of combination bag, mat, and flotation devices connected in the mat configuration;

such that a first combination bag, mat, and flotation device in the mat configuration is overlayed onto a second combination bag, mat, and flotation device in the mat configuration; and such that a first opening of the first plurality of openings of the first combination bag, mat, and flotation device aligns with a second opening of the first plurality of openings of the second combination bag, mat, and flotation device;

wherein at least one stake of the plurality of stakes is inserted into the first opening and the second opening, which are overlayed, thereby securing the first combination bag, mat, and flotation device to the second combination bag, mat, and flotation device.

* * * * *